US012692051B2

(12) United States Patent
Hamel et al.

(10) Patent No.: US 12,692,051 B2
(45) **Date of Patent: *Jul. 28, 2026**

(54) SPORT WATER BOTTLE WITH HIGH FLOW RATE

(71) Applicant: Bivo, LLC, Richmond, VT (US)

(72) Inventors: Carina Mary Hamel, Richmond, VT (US); Robert Hart Ringer, Richmond, VT (US); Peter William Hazelett, Portland, OR (US); Casey J. Davis, Williamstown, VT (US); Christopher Ian Jones, Portland, OR (US); Daniel William Peter, Portland, OR (US); Mark Callen Beard, Seattle, WA (US)

(73) Assignee: BIVO, LLC, Richmond, VT (US)

( * ) Notice: Subject to any disclaimer, the term of this patent is extended or adjusted under 35 U.S.C. 154(b) by 21 days.

This patent is subject to a terminal disclaimer.

(21) Appl. No.: 19/009,363

(22) Filed: Jan. 3, 2025

(65) Prior Publication Data

US 2025/0250076 A1 Aug. 7, 2025

Related U.S. Application Data

(63) Continuation of application No. 18/480,765, filed on Oct. 4, 2023, now Pat. No. 12,187,502, which is a continuation of application No. 17/168,072, filed on Feb. 4, 2021, now Pat. No. 11,780,657.

(60) Provisional application No. 62/971,836, filed on Feb. 7, 2020.

(51) Int. Cl.
*B65D 47/12* (2006.01)

(52) U.S. Cl.
CPC ..... *B65D 47/122* (2013.01); *B65D 2205/00* (2013.01)

(58) Field of Classification Search
CPC ..... B65D 47/122; B65D 2205/00; B65D 47/243; B65D 47/32; B65D 2543/00092; B65D 51/18; B65D 2543/00537; B65D 51/16; B65D 51/1644; B65D 51/24; B65D 47/061; B65D 47/248; B65D 47/24; B65D 51/1688; A47G 19/2272
USPC ..... 220/717, 367.1, 705, 366.1, 271, 373, 220/303, 714, 203.19, 361
See application file for complete search history.

(56) References Cited

U.S. PATENT DOCUMENTS

2011/0168292 A1* 7/2011 Luzbetak ..... B65D 47/0804 141/2
2015/0164254 A1* 6/2015 Niedens ..... A61G 7/05 220/714

* cited by examiner

*Primary Examiner* — Don M Anderson
*Assistant Examiner* — John Martin Hoppmann
(74) *Attorney, Agent, or Firm* — VIA LLP

(57) ABSTRACT

A bottle assembly has a bottle and a removable cap. The cap includes a nozzle and a vent arrangement. The vent arrangement can include a vent conduit that extends into an air cavity present at the bottom of the bottle assembly when the bottle assembly is inverted. The vent arrangement allows for pressure equalization within the bottom assembly in response to liquid being dispensed from the bottle assembly to permit high flow rates of the dispensed liquid without squeezing of the bottle.

16 Claims, 21 Drawing Sheets

SPORT WATER BOTTLE WITH HIGH FLOW RATE

CROSS-REFERENCE TO RELATED APPLICATIONS

This application is a continuation of U.S. patent application Ser. No. 18/480,765, filed Oct. 4, 2023, which is a continuation of U.S. patent application Ser. No. 17/168,072, filed Feb. 4, 2021, now U.S. Pat. No. 11,780,657 and claims the benefit of U.S. Provisional Application No. 62/971,836, filed Feb. 7, 2020.

BACKGROUND

Field

The present disclosure relates to water or other liquid beverage bottles. In particular, the present disclosure relates to water or other liquid beverage bottles well suited for use in cycling activities, among other activities.

Description of the Related Art

Although many designs of water bottles exist, a need remains for improved water bottles. For example, a need exists for water bottles with improved water flow, ease of use, durability, and taste.

SUMMARY

The systems, methods and devices described herein have innovative aspects, no single one of which is indispensable or solely responsible for their desirable attributes. Without limiting the scope of the claims, some of the advantageous features will now be summarized.

In some implementations, a sports beverage bottle assembly comprises a bottle defining a closed bottom end and an open top end. A cap is selectively connectable to the bottle and configured to close the open top end of the bottle. The bottle and the cap cooperate to define an interior space of the bottle assembly. A nozzle is carried by the cap. The nozzle is movable between an open position and a closed position. The liquid contents of the bottle can be dispensed through an outlet passage of the nozzle when the nozzle is in the open position. A vent is configured to permit a vent flow of vent air from an atmosphere outside of the bottle assembly to the interior space of the bottle assembly through a vent passage. A vent conduit extends from the vent passage to a terminal end located within the bottle. The bottle assembly is configured to dispense the liquid contents through the outlet passage of the nozzle in response to the bottle assembly being tilted sufficiently toward an inverted position for the liquid contents to enter the outlet passage of the nozzle.

In some implementations, the movement of the nozzle between the open position and the closed position is linear movement.

In some implementations, the cap comprises a tubular nozzle receiver that supports the nozzle for movement between the open position and the closed position, wherein the tubular nozzle receiver and the nozzle cooperate to define one or more windows that permit entry of the liquid contents into the outlet passage of the nozzle.

In some implementations, the one or more windows define a total area of at least 65 square millimeters.

In some implementations, the outlet passage of the nozzle defines a minimum diameter of at least 9 millimeters.

In some implementations, the vent passage extends through the cap.

In some implementations, the terminal end of the vent conduit is located adjacent the closed bottom end of the bottle.

In some implementations, the vent conduit is removably connected to the cap.

In some implementations, a water trap is positioned between the vent passage and the terminal end, the water trap configured to accommodate water from within an interior of the vent conduit.

In some implementations, a vent plug is configured to selectively open and close the vent passage.

In some implementations, the vent plug moves with the nozzle.

In some implementations, the vent plug and the nozzle are formed as a single piece.

In some implementations, the vent plug comprises an elongate projection and the vent comprises a cylindrical surface defining a portion of the vent passage such that the vent plug contacts the cylindrical surface of the vent passage when the nozzle is in the closed position.

In some implementations, the vent plug comprises a part spherical projection and the vent comprises a chamfered surface defining a portion of the vent passage such that a circular line of contact is defined between the part spherical projection and the chamfered surface when the vent plug closes the vent passage.

In some implementations, the cap is connectable to the bottle by a threaded connection in which threads are located on an interior surface of the bottle.

In some implementations, the cap defines a cavity located the top end of the bottle with the cap attached to the bottle, wherein a volume of the cavity is at least about 5% of a volume of the interior space of the bottle.

In some implementations, a ratio between a minimum cross-sectional area of the outlet passage and a minimum cross-sectional area of the vent passage is equal to or less than about 14:1.

In some implementations, the cap comprises a tubular nozzle receiver that supports the nozzle, the tubular nozzle receiver comprising an elevated inner platform with a lateral sealing surface and a vertical sealing surface, the nozzle comprises a round sealing surface, wherein the round sealing surface abuts the lateral sealing surface and the vertical sealing surface.

In some implementations, a check valve is configured to permit the vent flow of air and inhibit or prevent a flow of air or the liquid contents through the vent passage in a direction from the interior space of the bottle assembly to the atmosphere.

In some implementations, the bottle comprises an outer layer of a grip material.

In some implementations, the bottle is constructed of a rigid material.

In some implementations, an outer surface of a sidewall of the bottle defines a shoulder that extends in a circumferential direction around the bottle.

In some implementations, the nozzle is removable from the cap.

In some implementations, the nozzle comprises an indicator to indicate to the user the location on the nozzle to push for removal of the nozzle.

In some implementations, a water bottle includes an outlet and an inlet. The outlet and the inlet are coupled such that they open and close simultaneously.

In some implementations, the outlet is for water flow.

In some implementations, the inlet is for airflow.

In some implementations, the inlet is functionally coupled to a vent straw.

In some implementations, a closing surface that seals the inlet is fixed to a flexible arm.

In some implementations, the outlet is a nozzle.

In some implementations, the inlet is a vent.

In some implementations, a water bottle includes a vent straw, a cap, and a bottle. The cap and the bottle can be assembled. The cap defines a cavity above a maximum fill volume of the bottle.

In some implementations, the bottle has a region at the bottom of the bottle. The volume of the region is equal to the volume of the cavity. The vent straw has a terminal end located in the region.

In some implementations, the vent straw is angled such that the terminal end of the straw is located on the longitudinal axis of the bottle.

In some implementations, the vent straw has an angular cut at the terminal end.

In some implementations, the water bottle includes a water outlet, and an air inlet. The water outlet has a first minimum cross-sectional area. The air inlet has a second minimum cross-sectional area. The ratio between the first cross-sectional area and the second cross-sectional area is equal to or less than about 14:1.

In some implementations, the first cross-sectional area is about 98 square millimeters.

In some implementations, the air inlet comprises a vent straw with an interior diameter of about 3 millimeters.

In some implementations, the water outlet comprises a gate.

In some implementations, the gate has a travel distance of about 3.6 millimeters.

In some implementations, the air inlet comprises a vent straw.

In some implementations, the vent straw is at least a distance away from a bottom of a bottle.

In some implementations, a vent plug for a water bottle includes a vent and a plug. The plug has a round seal surface with an approximately semispherical shape. The vent has a cone recess. A leading edge of the cone recess is not rounded. The plug seals against the vent with a circular seal defined by the leading edge of the cone recess.

In some implementations, a vent straw is connected to the vent and the vent straw extends to near the bottom of the bottle.

In some implementations, a nozzle assembly for a cycling water bottle includes a nozzle receiver, and a nozzle insert. The nozzle receiver has an elevated inner platform with a lateral sealing surface and a vertical sealing surface. The nozzle insert has a round sealing surface. The round sealing surface abuts the lateral sealing surface and the vertical sealing surface.

In some implementations, the lateral sealing surface extends past the round sealing surface.

In some implementations, a vent straw assembly for a cycling water bottle includes a vent plug removably sealing a recess. The recess has an air-tight connection to a passage. The passage has an air-tight connection to a straw receiver. The straw receiver has a removable air-tight connection to a vent straw.

In some implementations, the vent straw is fully contained within a bottle assembly.

In some implementations, the vent straw is for air.

In some implementations, the vent straw has an internal diameter of at least about 3 millimeters.

In some implementations, a water bottle includes a nozzle defining an outlet, a check valve, and a plug connected to the nozzle and configured to selectively cover the check valve.

In some implementations, the plug further comprises a recess to accommodate a portion of the check valve.

In some implementations, the nozzle and the plug are configured to translate along an axis with one another between an open position and a closed position of the outlet.

In some implementations, the outlet is for water or liquid flow.

In some implementations, the check valve is an umbrella valve.

In some implementations, the check valve is functionally coupled to a vent conduit.

In some implementations, the vent conduit is a vent straw.

In some implementations, a water bottle includes a nozzle defining an outlet, a vent arrangement comprising a vent and a check valve that selectively opens and closes the vent. A vent conduit extends from the vent toward a bottom of a bottle portion of the water bottle at least past a lid of the water bottle. The vent conduit defines an interior space in communication with the vent.

In some implementations, a water bottle includes a nozzle defining an outlet, a vent arrangement comprising at least one vent passage, and a vent conduit that extends from a first end at or near the vent passage to a terminal end toward a bottom of a bottle portion of the water bottle. The vent conduit defines an interior space in communication with the vent. A water trap is positioned between the at least one vent passage and the terminal end. The water trap is configured to accommodate water from the interior space of the vent conduit.

In some implementations, the vent conduit comprises a down straw between the water trap and the at least one vent passage and a main straw on an opposite side of the water trap from the down straw.

In some implementations, the down straw protrudes into a chamber of the water trap to define a space surrounding the down straw and defined by an interior surface of a body of the water trap and an end of the down straw within the water trap.

In some implementations, the space defines a volume that is equal to or greater than an interior volume of the main straw. In some such implementations, an interior diameter of the main straw is at least 7 mm.

In some implementations, an interior passage of the main straw is tapered and enlarges in a direction from the terminal end toward the water trap. In some such implementations, a minimum diameter of the interior passage is about 3 mm and a maximum diameter of the interior passage is at least about 7 mm.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
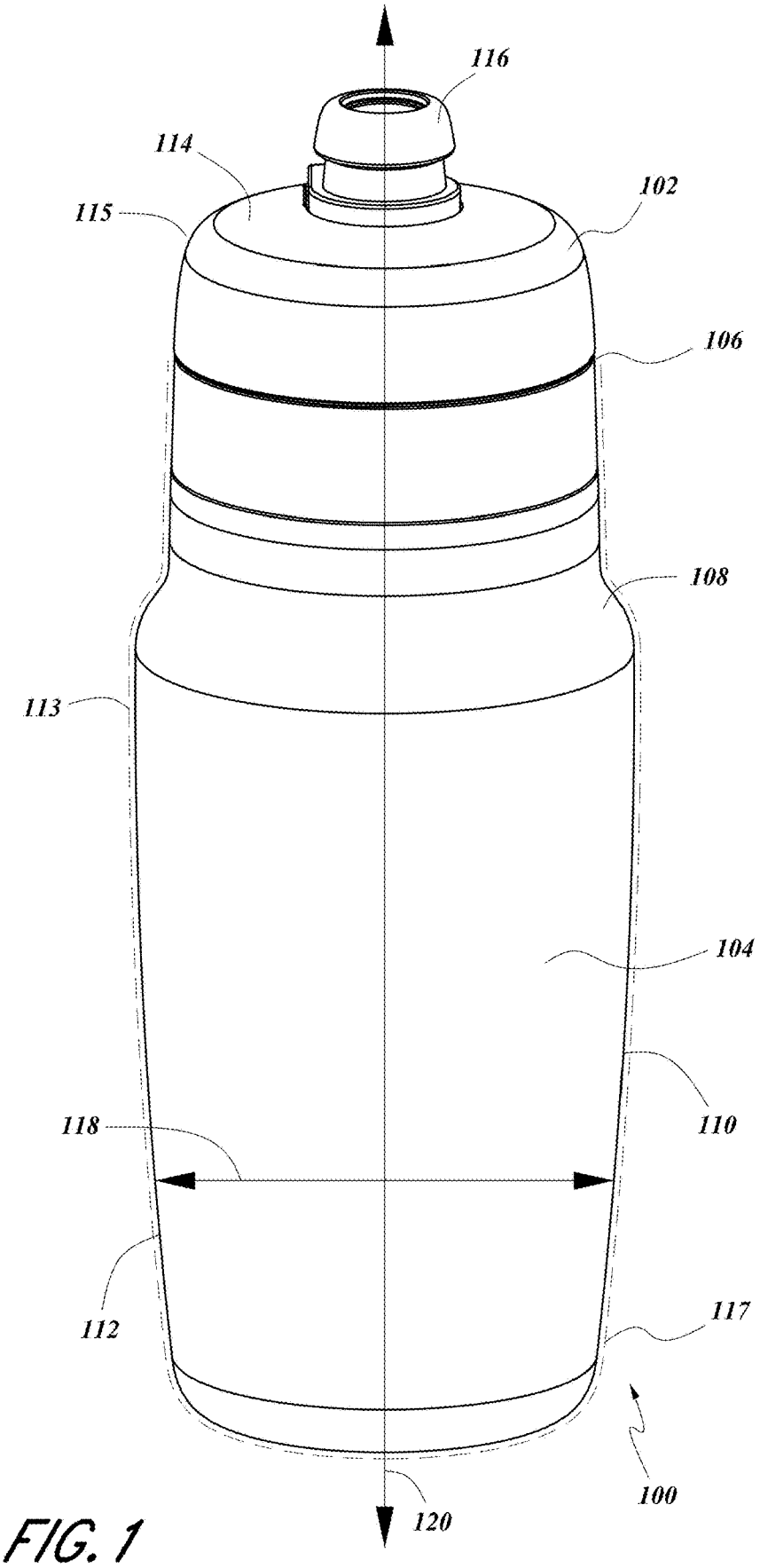
FIG. 1 is a front and top view of a bottle assembly having a bottle portion and a cap.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions herein extend beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made or relative to the bottle as oriented in an upright position. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

The illustrated bottle assembly, which is sometimes simply referred to as a "bottle" herein, is a relatively rigid container configured for use in cycling or other sports or activities. Conventional cycling bottles typically dispense the liquid contents of the bottle by tilting the bottle toward or to an inverted position a sufficient amount to position the liquid contents within the nozzle of the cap. While gravity usually provides some of the force required to dispense liquid from the conventional cycling bottle, the user often squeezes the bottle to provide additional dispensing force and increase the rate of flow from the bottle. The amount of tilt or inversion required to dispense the liquid contents typically varies with the level of the liquid contents within the bottle. These types of bottles can be referred to as gravity, tilting or inversion type bottles, which is in contrast to bottles that utilize a straw to draw liquid from a location near the bottom of the bottle and are designed for use in an upright or relatively upright position. In some configurations of the disclosed embodiments, the bottle is a tilting or inversion type bottle. In some configurations, the bottle is non-squeezable. As used herein, the term "non-squeezable" is used to contrast the illustrated bottle with a standard plastic cycling water bottle, in which pressure generated by squeezing of the bottle by the user is the usual or primary mechanism for dispensing the contents of the bottle. A "non-squeezable" bottle may be somewhat collapsible, but is more rigid than a standard plastic cycling bottle. A "non-squeezable" bottle may be sufficiently rigid such that it is not deformable by squeezing within the hand of a user to an extent that provides significant pressure for dispensing of the contents. The bottle can be constructed from a metal or similarly rigid material. Preferably, the illustrated rigid bottle can approximate, meet or even exceed the performance of a standard, squeezable plastic water bottle with respect to ease of use and/or flow rate. Although the present bottle is disclosed in the context of a cycling application, in alternative applications, the devices, or components thereof, as disclosed or modified by one skilled in the art could be utilized for other types of sports or activity bottles, or for other types of liquid containers more generally. It should be understood that the term water bottle is used broadly to include all beverage bottles. It should be understood that the term water is used broadly to include all beverages or other liquids potentially contained in the water bottle.

The bottle assembly 100, which in the illustrated configuration is a rigid inversion or tilting type cycling bottle, can include a screw-on cap 102 attachable to a bottle portion or bottle 104. The cap 102 and the bottle 104 can be screwed together, and may form a seal at an interface 106 between the two components. However, other types of removable connections between the bottle 104 and the cap 102 can also be used. The cap 102 can be selectively removed from the bottle 104 to provide access to the interior cavity of the bottle 104, such as to fill or refill the bottle 104 with a liquid.

The illustrated bottle 104 defines a rounded shoulder 108 extending in a circumferential direction around a sidewall 110 of the bottle 104. The shape of the cycling bottle assembly 100 may be partially defined by the shoulder section 108 and the sidewall 110. In particular, the bottle 104 defines an exterior surface 112 and the cap 102 defines an exterior surface 114. The exterior surfaces 112, 114 of the bottle 104 and the cap 102 cooperate to form the basic outer shape or profile of the bottle assembly 100. The cap 102 may include a nozzle 116, through which contents of the bottle 104 can be dispensed.

A radial cross-sectional dimension, which can be a diameter 118, of the bottle 104 may vary along the longitudinal axis 120 that extends in a direction between a closed bottom and an open top of the bottle 104. The shape of the bottle 104 may facilitate loading or unloading of the bottle 104 into or from a bicycle water bottle cage. The bottle cage is not shown, but often includes a retention lip or similar structure that engages the shoulder 108 to assist in retention of the bottle 104 within the bottle cage. The diameter 118 of the bottle 104 may be selected to provide a desired volume while allowing the bottle 104 to readily fit into a standard bottle cage. Accordingly, the shoulder 108 may have dimensions which allow the bottle 104 to fit and be held in a standard bicycle water bottle cage.

In some implementations, the bottle 104 may be made of or comprises stainless steel. Stainless steel is an advantageous material for liquid beverage bottles because it resists corrosion, does not leach flavor into the liquid contents of the bottle 104, and provides durability to the bottle 104. In other implementations, the bottle 104 could be made of or comprise different materials with different properties or a combination of materials (e.g., carbon fiber composite). At least a portion of the cap 102 may be constructed from any one or combination of suitable plastic materials by any suitable processes, such as injection molding. In other configurations, at least a portion of the cap 102 may be made of stainless steel to resist corrosion.

As noted above, in the illustrated arrangement, the bottle assembly 100 provides a sufficient emptying flow rate through the nozzle 116 for use as a cycling bottle, which may be comparable to or better than a conventional squeezable plastic cycling bottle, despite the bottle 104 being relatively non-squeezable. Certain features that facilitate the sufficient emptying or dispensing flow rate through the nozzle 116 are described below. These features can be used individually or in any combination. One such feature is a vent that permits ambient air to enter the bottle 104 as the liquid within the bottle 104 is dispensed through the nozzle 116. The vent can define a vent flow path that is separate from the liquid flow path of the nozzle 116. However, portions of the nozzle 116 and the vent arrangement can be coupled, as is described in further detail below. In some configurations, a ratio between a minimum cross-sectional area of the outlet passage and a minimum cross-sectional area of the vent passage is equal to or less than about 20:1, 15:1, 14:1, or 12:1. In some configurations, a ratio between the minimum cross-sectional area of the outlet passage and the minimum cross-sectional area of the vent passage is equal to or less than about 10:1 or 9:1 (9.5:1 or 9.6:1). It is presently believed that such ratios provide sufficient venting for the flow rate provided by a given size of outlet passage.

Figure 2:
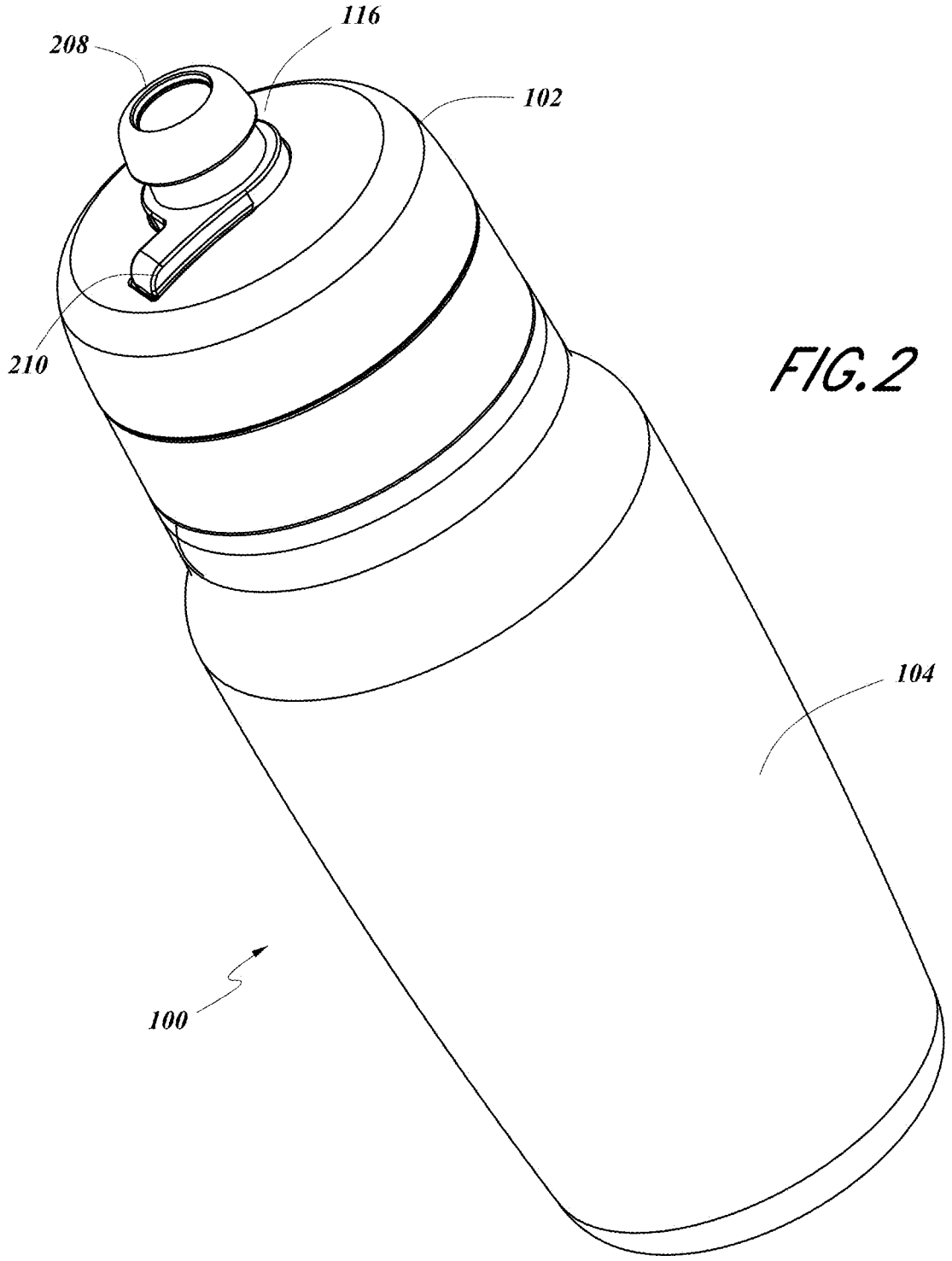
FIG. 2 is perspective view of the bottle assembly showing the nozzle of the cap.

With reference to FIG. 2, the nozzle 116 may have a nozzle portion 208 and a vent plug portion 210. The nozzle portion 208 defines the dispensing outlet for the liquid contained within the bottle assembly 100. The vent plug portion 210 selectively opens or closes the vent arrangement, as is described in further detail below. The nozzle portion 208 and the vent plug portion 210 may be connected to one another such that the vent plug portion 210 moves along with movement of the nozzle portion 208. The nozzle 116 can be moved axially or linearly relative to the body of the cap 102 between an open position and a closed position. In the illustrated arrangement, when the nozzle 116 is in the open or up position, the nozzle portion 208 and the vent plug portion 210 are open. When nozzle 116 is in the closed or down position, the nozzle portion 208 and the vent plug portion 210 are closed. Advantageously, the connection of the vent plug portion 210 and the nozzle portion 208 allows them to be opened and closed simultaneously. An axial or linear nozzle is typical for cycling bottles; however, in other configurations, the nozzle 116 can open by a different motion. For example, the nozzle 116 can open by a twist motion or by rotation away from or towards the cap 102 (e.g., a flip nozzle).

The vent plug portion 210 and the nozzle portion 208 may be formed as a unitary or one-piece structure. Alternatively, the vent plug portion 210 and the nozzle portion 208 can be separately formed and subsequently connected for movement as a unit. In some further implementations, if desired, the vent plug portion 210 and the nozzle portion 208 may be movable independently of one another. In some implementations, the nozzle 116 may have a distinctive 'b' shape when the bottle assembly 100 is viewed from above or when viewing the top of the cap 102. In other implementations, a different shape may be used. The nozzle 116 may be removable from the cap 102 for cleaning or replacement, as is described in further detail below.

Figure 3:
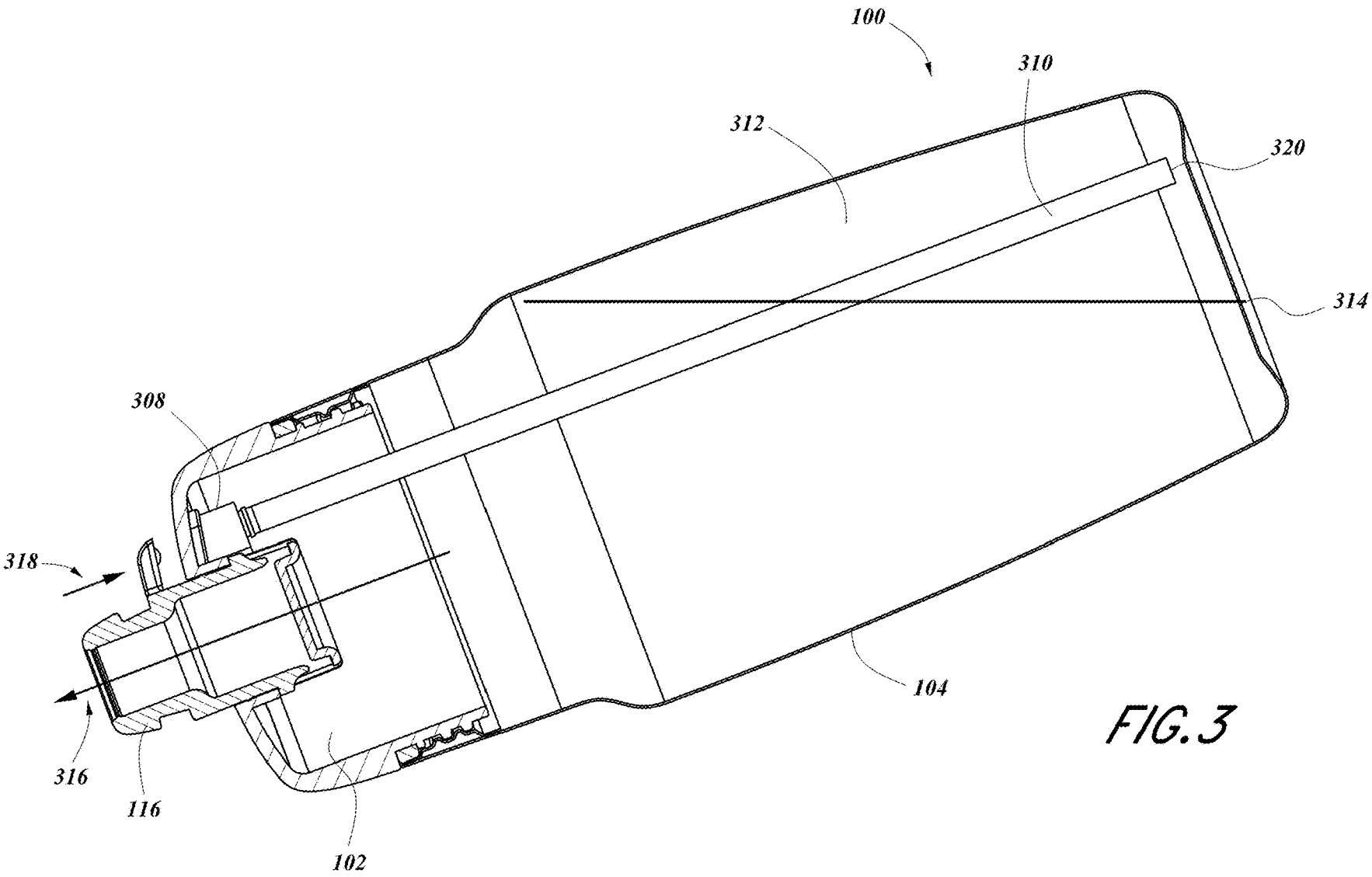
FIG. 3 is a sectional view of the bottle assembly in operation in a tilted or partially inverted position.

With reference to FIG. 3, the cap 102 includes a vent body 308, which can include or define a vent in the cap 102, as is described in further detail below. In some configurations, a vent conduit 310 in the form of a vent straw is attached to the vent body 308 and extends toward the bottom of the bottle 104. In the illustrated arrangement, a terminal end 332 of the vent conduit 310 is located close to or adjacent to a bottom of the bottle 104 and preferably within an air cavity 312 present at the bottom of the bottle 104 when the bottle assembly 100 is at least partially inverted with the cap 102 lower than the bottom of the bottle 104. When the bottle 104 is tilted to a sufficiently inverted position, such as a position in which the liquid contents of the bottle assembly 100 can enter the nozzle 116 that occurs when a user drinks from the bottle assembly 100, the air cavity 312 is defined by the bottle 104 and the water level 314. The air cavity 312 changes location with movement of the bottle assembly 100 between different levels of inversion; however, FIG. 3 illustrates an example location of the air cavity 312 for the purpose of explanation of the operation of the bottle assembly 100.

When the bottle 104 is tipped, as shown, the force of gravity tends to pull water out of the nozzle 116. The user may allow gravity to control the dispensing of the liquid contents of the bottle assembly 100 or may suck on the nozzle 116 to increase the flow rate of the liquid contents from the bottle assembly 100. The water exiting the bottle assembly 100 through the nozzle 116 can be referred to herein as a dispensing flow of water 316. The dispensing flow of water 316 out of the bottle assembly 100 generates a negative pressure in the air cavity 312. As the pressure of air cavity 312 drops below ambient pressure, a flow of air 318 moves in a direction from the ambient environment outside the bottle assembly 100 to the air cavity 312 within the bottle 104 via the vent body 308 and vent conduit 310. This flow of air 318 can be referred to herein as a vent flow of air 318. If the flow of liquid out of the bottle assembly 100 through the nozzle 116 continues, the vent flow of air 318 continues to pass through the vent conduit 310 and into the air cavity 312 in response to a pressure differential between the outside environment and the air cavity 312. The vent flow of air 318 to the air cavity 312 through the vent arrangement (e.g., vent body 308 and vent conduit 310) hastens the dispensing flow of water 316 through the nozzle 116 in comparison to an arrangement in which vent air passes through the nozzle 116.

The vent conduit 310 can be any suitable structure that permits air to move from the vent body 308 to the air cavity 312 (or generally into the interior of the bottle 104). For example, the vent conduit 310 can be a straw, another tubular structure, or any other type of suitable channel. In some configurations, the vent conduit 310 is removable from the vent body 308 for cleaning or replacement. In other configurations, the vent conduit 310 can be integrated or unitarily formed with one or both of the cap 102 or bottle 104. In yet other configurations, the vent conduit 310 can be omitted. The vent conduit 310 is presently preferred because the direct delivery of the flow of air 318 to the air cavity 312 (or close to the air cavity 312) is believed to reduce the resistance to dispensing flow through the nozzle 116 and/or segregates the flow of air 318 from the liquid exiting through the nozzle 116. However, in other arrangements, the vent conduit 310 can be omitted or provided in shortened form or a different form from that illustrated and the flow of air 318 can pass through the liquid contents of the bottle assembly 100 from the vent body 308 to the air cavity 312. It is presently preferred that the terminal end 332 of the vent conduit 310 be positioned at a spaced location from the vent body 308, which can be outside of the cap 102 and within the interior space of the bottle 104. The terminal end 332 can be closer to the bottom of the bottle 104 than the open top end of the bottle 104. In some configurations, the terminal end 332 is located within a bottom 50%, 25%, 10% or 5% of the height and/or volume of the bottle 104 or the combination of the bottle 104 and the cap 102. It is desirable that when the bottle assembly 100 is full of liquid contents, the air cavity 312 is sized such that the terminal end 332 is located within the air cavity 312 when the bottle assembly 100 is tilted to a use position. However, it is possible that the terminal end 312 may be covered by the liquid contents (and, thus, may not be within the air cavity 312) in some orientations of the bottle assembly 100 or under some circumstances. In such a situation, it is presently believed that positioning the terminal end 332 close to the bottom of the bottle 104 reduces the amount of the liquid contents through which the flow of vent air 318 must pass and, therefore, reduces the resistance to the flow of vent air 318 so that the flow of vent air 318 occurs at a lower differential pressure between the air cavity 312 and the ambient atmosphere.

The result of the above-described arrangement is improved water flow 316 and improved air flow 318 while the bottle assembly 100 is tipped as compared to an unvented substantially rigid water bottle. An advantageous function of the vent conduit 310 is to create a dedicated and one-way flow channel for air to enter the bottle assembly 100. Another beneficial aspect is that the vent conduit 310 may clear itself of at least some amount of water as a result of the vent flow of air 318. The vent flow of air 318 tends to clear water remaining within the vent conduit 310 into the interior of the bottle 104. As a result, the conduit 310 normally will not become inundated with water when the bottle assembly 100 is tipped. Because the vent conduit 310 may clear itself of at least some of the water located within the vent conduit 310, it may not be necessary for a valve to be installed into the terminal end of the vent conduit 310, which allows for a simpler, more reliable design, reduced manufacturing cost, and/or better performance. Under some conditions, the vent conduit 310 may not be cleared of all water as a result of the vent flow of air 318 and it is possible that some water may exit the bottle assembly 100 through the vent passage 944. However, the amount of water that exits through the vent passage 944 normally will be small, which may present itself as a small drip. In some applications, such a small dripping of water may be tolerated by the user.

Preferably, the vent conduit 310 has an interior cross-sectional area selected to permit a sufficient flow rate of the vent flow of air 318 and/or avoid excessive capillary action of the liquid within the bottle assembly 100 that would tend to draw too much liquid into the vent conduit 310 and interfere with the satisfactory operation of the vent conduit 310. In some implementations, the vent conduit 310 may have a diameter of at least about 3 mm—or an equivalent cross-sectional area for non-circular shapes. The diameter or cross-sectional area can be constant or can vary along the length of the vent conduit 310. Thus, in arrangements in which the diameter or cross-sectional area varies, the dimensions recited above can be a minimum dimension of the vent conduit 310. The advantage of this size is that it may ensure a self-clearing function while not restricting air flow into the bottle 104. In some configurations, the vent conduit 310 may have a maximum diameter of about 6 mm to inhibit excessive creep of water into the vent conduit 310.

Figure 15:
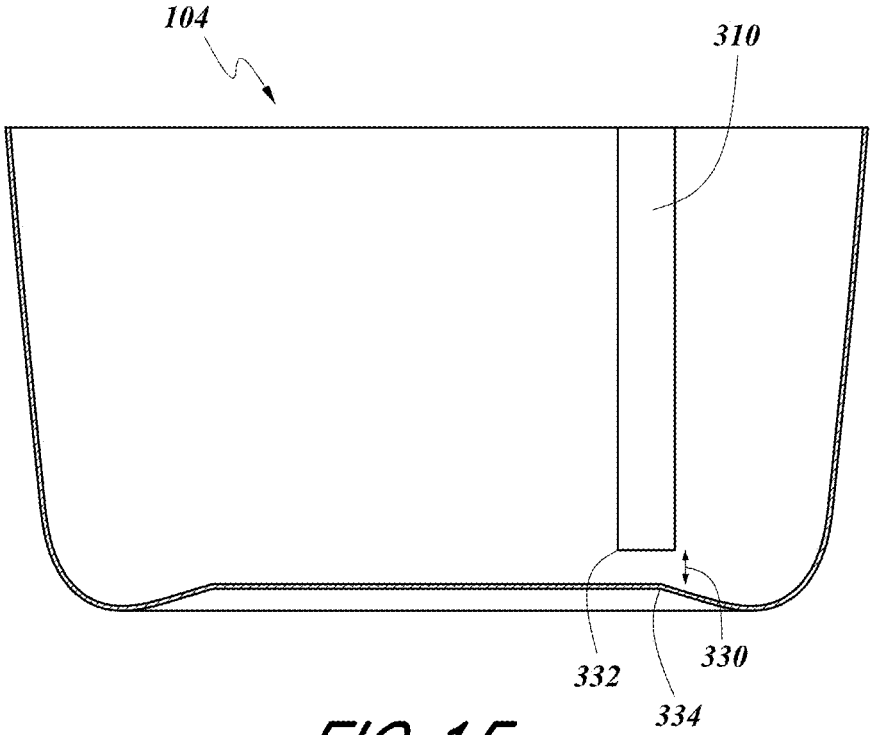
FIG. 15 is a sectional view of the bottom of the bottle showing a terminal location of the vent straw.

In various implementations, with additional reference to FIG. 15, the vent conduit 310 may extend into the bottle 104 a sufficient distance such that the terminal end 332 of the vent conduit 310 is spaced from the upper end of the bottle 104. In the illustrated arrangement, the terminal end 332 of the vent conduit 310 is located relatively close to the bottom 334 of the bottle 104, but defines a clearance distance 330 with the bottom 334 of the bottle 104. In general, increasing the distance the vent conduit 310 extends into the bottle 104 increases a pressure head difference between the nozzle 116 and the terminal end 332 of the vent conduit 310. This pressure difference may facilitate the dispensing flow of water 316 and inhibit or prevent water flow through the vent conduit 310 in a direction towards the vent body 308. In some configurations, the clearance distance 330 is equal to or less than about 50 mm, 25 mm, 10 mm or 5 mm.

In some embodiments, the terminal end 332 of the vent conduit 310 could have an angled (e.g., 45°) cut to break surface tension at the opening to the internal passage of the conduit 310 at the terminal end 332. In such arrangements, the clearance distance 330 may be measured to a portion of the 45° angled surface furthest from the bottom 334 of the bottle 104. In some configurations, the clearance distance 330 is related to a diameter or cross-sectional area of the vent conduit 310. For example, the clearance distance 330 may be equal to or greater than a diameter of the vent conduit 310 or an area defined between the terminal end 332 of the vent conduit 310 and the bottom 334 of the bottle 104 may be equal to or greater than a cross-sectional area of the interior passage of the vent conduit 310.

An advantage of keeping the terminal end 332 of the vent conduit 310 a minimum distance (e.g., the clearance distance 330) from the bottom 334 of the bottle 104 may be that the distance between the vent conduit 310 and bottle 104 will not be the limiting factor for the vent flow of air 318. Furthermore, as discussed above, placing the terminal end 332 of the vent conduit 310 close to the bottom 334 of the bottle 104 can position the terminal end 332 within or close to the air cavity 312 when the bottle assembly 100 is in use, thereby eliminating or reducing the time bubbles are generated in the liquid within the bottle assembly 100. That is, bubbles may be generated in the liquid when the vent conduit 310 is underneath the water level 314. In such an instance, as the vent flow of air 318 rushes through the vent conduit 310 to equalize the pressure within the bottle assembly 100 to the ambient pressure, there will be bubbles produced which rise into the air cavity 312.

In some implementations, the vent conduit 310 is located relatively close to the longitudinal axis 120 of the bottle assembly 100. In some configurations, the vent conduit 310 is located as close to the longitudinal axis 120 as the design of the bottle assembly 100 allows, such as adjacent or abutting the nozzle 116 or related structure. Such an arrangement is advantageous to reduce or minimize the variability in how the venting system performs at various roll angles of the bottle assembly 100 when the vent conduit 310 is parallel to and offset from the longitudinal axis 120.

In alternative implementations, a portion or an entirety of the vent conduit 310 may be orientated at an angle relative to the longitudinal axis 120. The angle can be defined as the angle at which the conduit 310 or a portion thereof must be positioned such that the terminal end of the conduit 310 is located on the longitudinal axis 120 of the bottle 104 or bottle assembly 100. Orienting the vent conduit 310 or a portion thereof at such an angle may increase the likelihood that, once the bottle 104 is inverted, the vent conduit 310 will be located within the air cavity 312 thereby enabling rapid equalization of pressure without the formation of bubbles. Implementations including an angled conduit may allow a user to drink from more angles, with fewer bubbles being formed within the bottle, and with a more consistent flow rate of the dispensing flow of water 316.

In some implementations, the vent conduit 310 could be straight and in others it could be curved. Thus, the angle may be an effective angle rather than an angle defined by the physical vent conduit 310. The vent conduit 310 could also have multiple terminal ends, have a variety of shapes of the terminal ends, have a portion with an annular shape, or be mounted or formed from another part of the bottle assembly 100.

Figure 4:
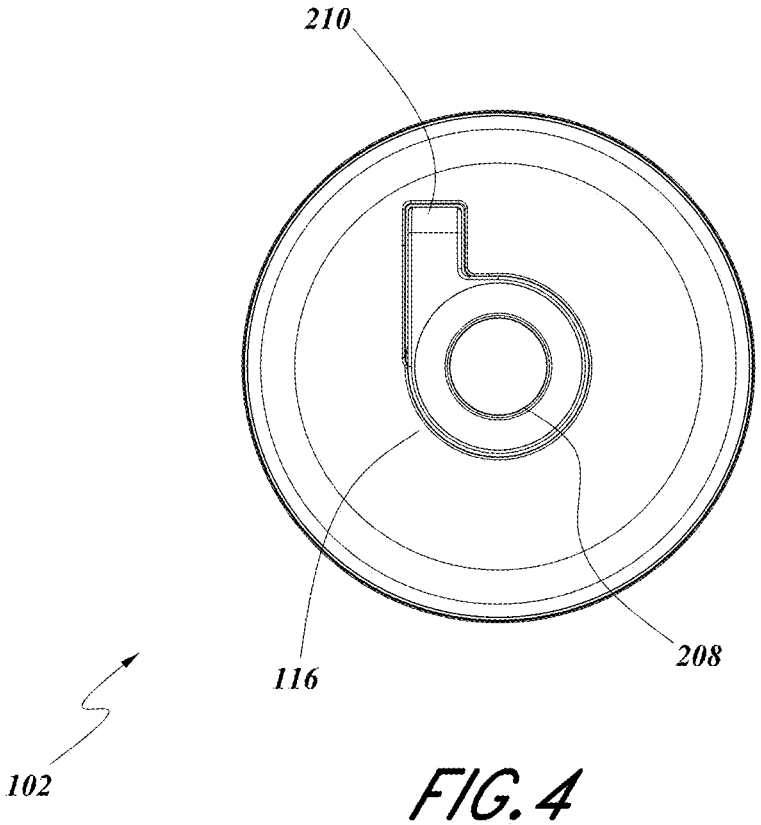
FIG. 4 is a top view of the bottle assembly.

With reference to FIG. 4, in the illustrated arrangement, the nozzle 116 is located in an approximate center of the cap 102. As noted above, the illustrated nozzle plug 116 is a single piece including the nozzle portion 208 and the vent plug portion 210. The nozzle portion 208 and the vent plug portion 210 of the nozzle 116 may cooperate to form a distinctive 'b' shape. However, such a shape is not necessary for the proper functioning of the nozzle 116 as will be apparent from the description below and/or in view of the entire contents of the disclosure. Preferably, the vent plug portion 210 is spaced in a radial direction from the nozzle portion 208; however, the vent plug portion 210 extends tangentially relative to the nozzle portion 208. Although the nozzle portion 208 and the vent plug portion 210 in the illustrated arrangement are formed as a single piece, in other configurations these portions 208, 210 can be formed separately and can be coupled for movement with one another.

Figure 5:
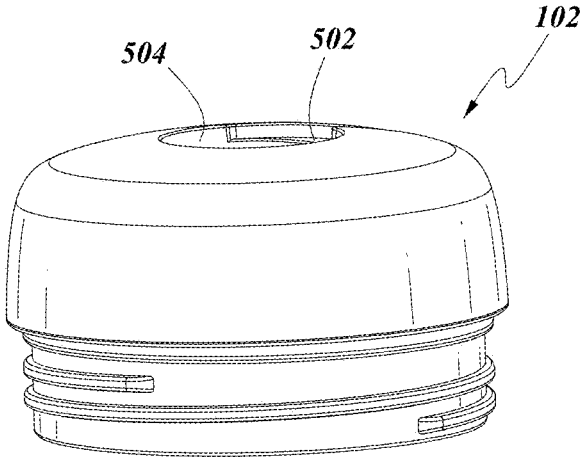
FIG. 5 is a perspective view of the cap without the nozzle.
Figure 6:
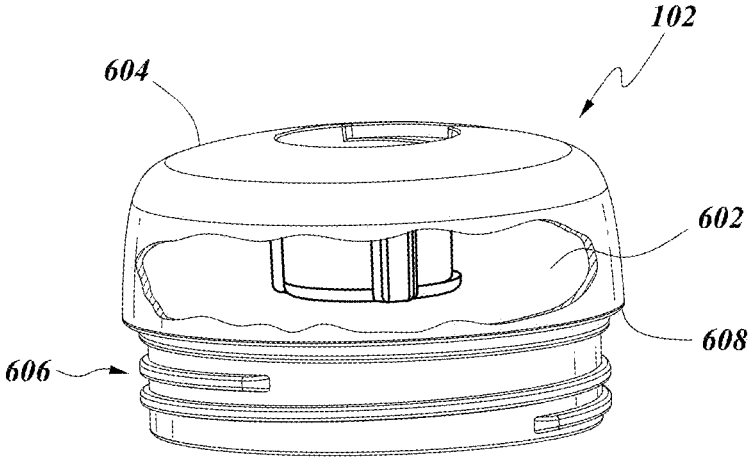
FIG. 6 is a perspective view of the cap with a portion of the cap cut away to show the internal cavity.

As noted above, the nozzle 116 can be removable from the cap 102 for any suitable purpose, such as cleaning or replacement. FIGS. 5 and 6 illustrate the cap 102 with the nozzle 116 removed. The illustrated cap 102 defines a region configured to accommodate the nozzle 116, which includes a vent plug receiver 502 and a nozzle receiver 504. Both the nozzle receiver 504 and the vent plug receiver 502 may be exposed on the top of the cap 102. The nozzle receiver 504 is an opening within the upper wall of the cap 102 configured to accommodate the nozzle portion 208 of the nozzle 116. The vent plug receiver 502 is a surface configured to accommodate the vent plug portion 210 of the nozzle 116. The vent plug receiver 502 may be defined by a recess in the upper wall of the cap 102.

Figure 8:
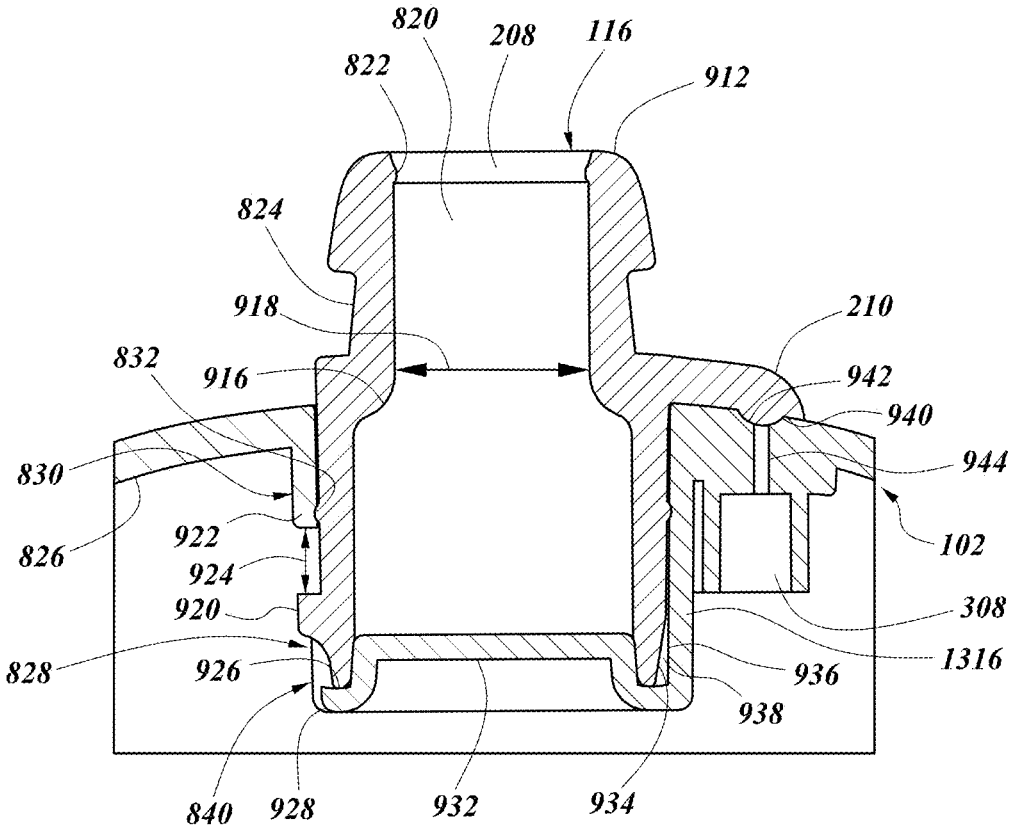
FIG. 8 is a sectional view of a portion of the cap showing the nozzle and vent of the bottle assembly with the nozzle in a closed position.

With particular reference to FIGS. 3, 6 and 8, the illustrated cap 102 defines an internal space or cavity 602 that is substantial in volume relative to a volume of the bottle 104. The cap 102 has an outer wall 604 that is substantially bowl-shaped or cup-shaped to define the substantial cavity 602 within the cap 102. The cap 102 is tall enough that the substantial cavity 602 is defined above a top of the bottle 104 when the cap 102 is assembled to the bottle 104.

When the bottle 104 is inverted, the amount of air contained in the cavity 602 of the cap 102 shifts to the bottom of the bottle 104. For example, as shown in FIG. 3, the air cavity 312 of FIG. 3 can be defined by the air present in the cavity 602. The size of the cavity 602 defines a minimum size of the air cavity 312 when the bottle 104 is full. As the bottle 104 empties, the air cavity 312 becomes greater than the volume of the cavity 602. As described above, the vent conduit 310 preferably opens to the air cavity 312 and the presence of a substantially-sized cavity 602 in the cap 102 provides a minimum air cavity 312 sized to ensure or increase the likelihood that the terminal end 332 of the vent conduit 310 will be located within the air cavity 312 when the bottle assembly 100 is tipped or inverted-even when the bottle 104 is full. In some embodiments, the volume of the cavity 602 defined by the cap 102 above the top of the bottle 104 may be at least about 5%, 10%, 15% or 20% of the volume of the bottle 104 or the combined volume of the cap 102 and the bottle 104. In some embodiments, the volume of the cavity 602 defined by the cap 102 above the top of the bottle 104 may be between about 5-25%, about 5-20%, or about 10-15% of the total volume of the bottle 104 or the combined volume of the cap 102 and the bottle 104. In some configurations, the volume of the cavity 602 defined by the cap 102 above the top of the bottle 104 is about 12-13% or 12% (12.2%) of the volume of the bottle 104 or about 10-11% (10.9%) of the combined volume of the cap 102 and the bottle 104.

In some configurations, the cavity 602 can be defined by the entire interior space of the cap 102. Although the cap 102 and the bottle 104 overlap at the junction 106 (FIG. 1), a user is likely to leave some empty space at the top of the bottle 104 to allow for assembly of the cap 102 to the bottle 104. However, the cavity 602 can also be defined by the space located above the top of the bottle 104 when the cap 102 is assembled to the bottle 104. When defined in this manner, the volume of the cavity 602 can provide a minimum volume of the air cavity 312, as shown in FIG. 3. In the illustrated arrangement, the cap 102 includes a threaded region 606, which engages a cooperating portion of the bottle 104. Thus, in the illustrated arrangement, the cavity 602 can be defined by the interior space of the cap 102 located above or towards the closed end of the cap 102 relative to the threaded region 606.

The threaded region 606 includes one or more threads, which in some instances be a single start thread or a multi start thread. The thread may in some implementations be an external thread as illustrated or, in other implementations, it could be an internal thread. An external thread on the cap 102 results in a corresponding internal thread on the bottle 104, as described below, which can provide the bottle 104 with a clean exterior appearance when the cap 102 is removed and can facilitate drinking from the bottle 104 when the cap 102 is not present. When the cap 102 is attached to the bottle 104, the cap 102 can be screwed on using the thread 606 until a contact or sealing surface 608 reaches the top of the bottle 104. Any one or more of the cap 102, the sealing surface 608 and the bottle 104 are configured to provide a sealed connection between the cap 102 and the bottle 104 when properly assembled. If desired, the sealing surface 608 can include or be defined by a seal member or gasket, such as an O-ring or square-ring, for example.

Figure 7:
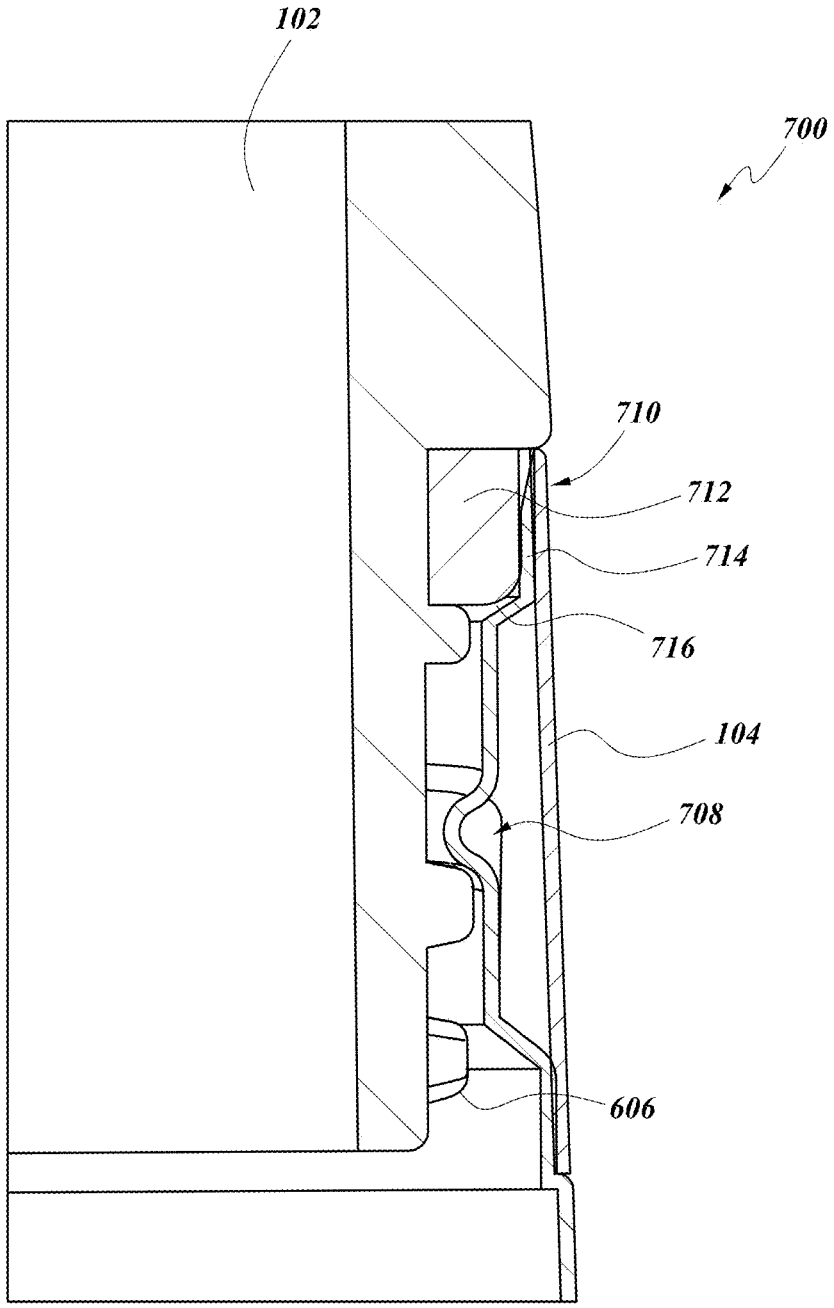
FIG. 7 is a sectional view of the interface between the cap and the bottle assembly.

With reference to FIG. 7, a cap bottle interface 700 is configured to connect the bottle 104 and the cap 102. In the illustrated arrangement, the bottle 104 has a bottle threaded region 708 comprising one or more threads configured to engage the threaded region 606 of the cap 102. The bottle 104 may have a double wall lip 710 with the interior wall defining the thread(s) of the threaded region 708. In some embodiments, as noted above, a seal 712 is present between the cap 102 and the bottle 104. The seal 712 may be a gasket or other suitable sealing member. In the illustrated arrangement, the seal 712 is carried by the cap 102. However, in other arrangements, the seal 712 could be carried by the bottle 104. In the illustrated arrangement, the bottle 104 includes a shoulder configured to engage the seal 712. The shoulder defines a first seal surface 714 and a second seal surface 716, one or both of which may be configured to contact the seal 712 when the cap 102 is fully assembled to the bottle 104.

As noted above, the double wall lip 710 is a built up drinking lip edge constructed from multiple (e.g., two) overlapping layers of material. Such a drinking lip edge is not typically seen on single wall bottles. This design allows for a smooth outer surface of the bottle 104 despite the thread(s) of the threaded region 708 of the interior wall. Thus, the bottle 104 has a smooth and attractive appearance with or without the cap 102. Such an arrangement may also facilitate drinking directly from the bottle 104 without the cap 102, which increases the usefulness of the bottle assembly 100. In other words, removal of the cap 102 allows the bottle 104 to be used as a stainless steel cup. Additionally, the double wall lip 710 makes drinking out of the bottle 104 without the cap 102 more pleasant and more like using a regular stainless steel cup. In some implementations, the bottle 104 may be a double wall body instead of a single wall body.

The seal 712 inhibits or prevents water from leaking out of the bottle through the interface. The seal 712 may also serves to prevent the cap from working its way off the bottle 104 during use. For example, use in a cycling application may cause the bottle assembly 100 to rattle and this rattling could cause the cap 102 to loosen and slowly twist off the bottle 104. The friction from the bottle seal 712 can reduce or eliminate this issue.

As described above, and with further reference to FIGS. 8 and 9, the bottle assembly 100 can include a vent arrangement, which allows a flow of vent air into the bottle assembly 100 through a separate flow path from the dispensed liquid exiting the bottle assembly 100. This flow of vent air replaces a volume of the dispensed liquid to reduce or avoid a pressure differential between the interior of the bottle assembly 100 and atmospheric pressure. In conventional bottles, air enters the bottle through the dispensing nozzle, thus interrupting the flow of the liquid being dispensed. In a squeezable sports bottle, the ability to achieve a high flow rate by squeezing the bottle somewhat compensates for the inefficiency of the shared flow path. However, squeezable bottles possess a number of drawbacks. The vent arrangement of the presently disclosed bottle assembly 100 provides better drinking performance by largely or completely separating the flow paths of the incoming air and the exiting liquid rather than relying on the brute force of squeezing the bottle. Thus, the bottle 104 can be relatively rigid, which provides for a longer lasting bottle and can allow for the use of metal (e.g., stainless steel) as the bottle material.

As also noted above, the vent arrangement and the dispensing nozzle can be functionally linked to one another so that a single action can open and/or close both the dispensing nozzle and the vent arrangement. As described above, the cap 102 may include the vent body 308, which includes, surrounds or defines a vent passage 944 in the cap 102. The vent body 308 may also function as a vent conduit receiver configured to receive and support the vent conduit 310. In some configurations, the vent body 308 and/or the vent conduit 310 may be integrated into the molded body of the cap 102. The vent plug portion 210 of the nozzle 116 is configured to selectively close the vent passage 944. The vent plug portion 210 may be molded as part of the nozzle 116. In some implementations, the vent plug portion 210 is configured to move along with the nozzle portion 208 of the nozzle 116. In some arrangements, the nozzle portion 208 and vent plug portion 210 may be unitary or molded as a single component. In other arrangements, the nozzle portion 208 and vent plug portion 210 could be otherwise coupled to one another. This operable connection allows for simultaneous opening and closing of the nozzle portion 208 and the vent plug portion 210, thus ensuring that the vent passage 944 is always open when the nozzle 116 is in use. The valve for water and the valve for air may thus be opened and closed simultaneously with a single moving part. The advantage of this implementation is that it is more efficient for the user to open and close the nozzle portion 208 and the vent plug portion 210 with a single movement. Additionally, the user will not mistakenly open only the nozzle portion 208 or only the vent plug portion 210.

The nozzle portion 208 of the nozzle 116 includes a nozzle opening 820 that extends through the nozzle portion 208 and connects the interior space of the bottle assembly 100 with the ambient environment outside of the bottle assembly 100. The nozzle opening 820 defines a portion of the dispensing flow path for the liquid exiting the bottle assembly 100. In some implementations, the nozzle opening 820 has no interior obstructions or structures extending across or protruding significantly into the nozzle opening 820, which can allow for unobstructed flow thereby increasing the flow rate through the nozzle 116.

A nozzle lip 822 can be provided at or adjacent an outlet end of the nozzle opening 820. In some configurations, the inside lip 822 can break water tension and separate the water flow from the surface of the nozzle 116 to reduce or prevent drippage. The nozzle 208 may have a rounded top edge 912 to provide comfort for the user. The nozzle 208 may have an inside ledge 916 which may be positioned where the interior diameter 918 rapidly changes—reduces in the direction of water flow exiting the nozzle 116. Similarly, in some embodiments the inside ledge 916 positioned inside the nozzle 208 can assist in breaking water tension and reducing or preventing drippage. The cap 102 itself has a rounded interior cap surface 826 which serves to increase flow of water toward the nozzle 116. The illustrated nozzle 116 includes a nozzle groove 824, which extends in a circumferential direction of the nozzle portion 208. The nozzle groove 824 can facilitate grasping of the nozzle 116 by the user's fingers or teeth to open the nozzle 116. When used during activities, such as cycling, a user often uses only one hand to hold the bottle assembly 100 and opens the nozzle 116 by holding the nozzle 116 in his or her teeth and pulling the bottle assembly 100 away from the mouth, leaving the other hand free.

Figure 9:
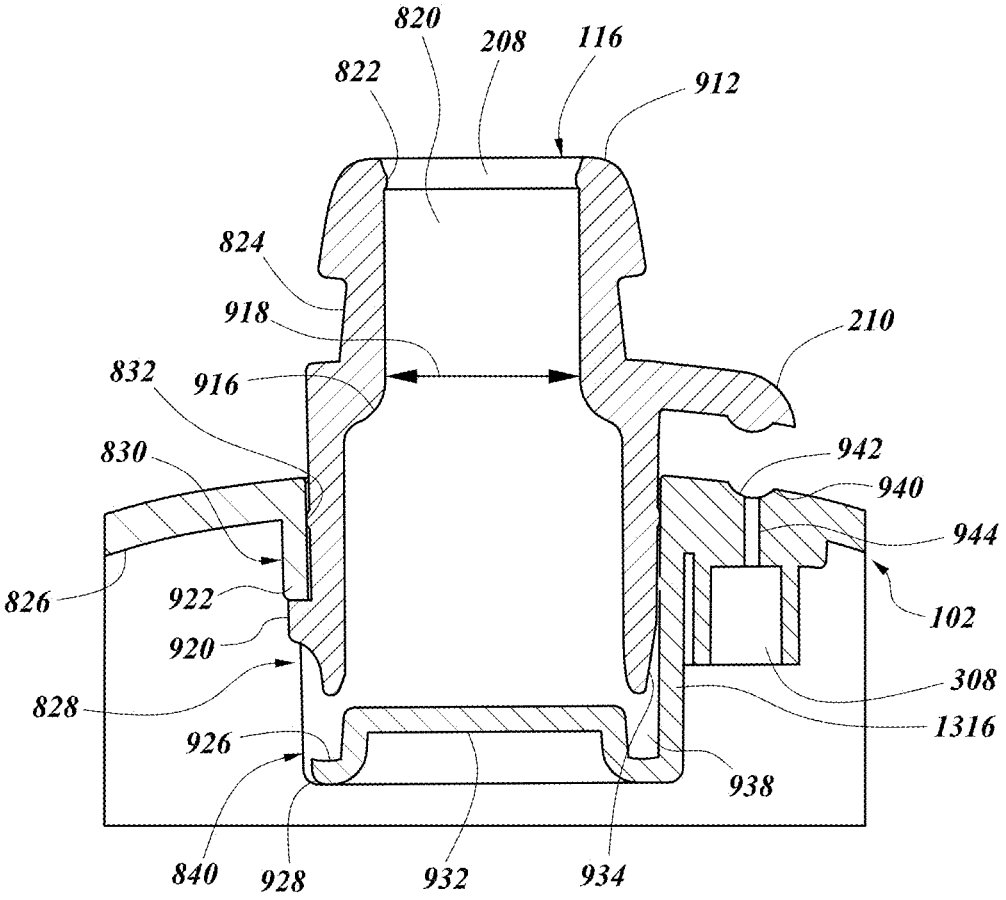
FIG. 9 is a sectional view of the portion of the cap of FIG. 8 with the nozzle in an open position.

The nozzle portion 208 of the nozzle 116 is configured to act as a valve body of a valve arrangement to selectively permit or prevent the flow of liquid through the nozzle opening 820. A portion of the nozzle portion 208 located within the cap 102 defines a gate portion or, simply, a gate 828 that cooperates with a valve seat structure of the cap 102 to selectively close the valve arrangement of the nozzle 116. FIG. 8 illustrates the nozzle 116 in a position with the gate 828 open (a relatively upward position) and FIG. 9 illustrates the nozzle 116 in a position with the gate 828 closed (a relatively downward position). In some implementations, the nozzle 116 has a relatively simple water path such that the water only has one or two turns between passing the gate 828 and exiting the nozzle opening 820.

The illustrated cap 102 includes a structure configured to support the nozzle portion 208 of the nozzle 116 and allow the nozzle 116 to move between the open position and the closed position. The structure also permits water or other liquid to be dispensed from the bottle assembly 100 through the nozzle 116. In the illustrated arrangement, the structure is a tubular support 830 that extends into the interior space of the cap 102. The tubular support 830 can have a cross-sectional shape that corresponds or is complementary to the cross-sectional shape of the nozzle portion 208 of the nozzle 116.

Preferably, the nozzle portion 208 and the tubular support 830 create a constant seal between them to inhibit or prevent leakage between the cap 102 and the nozzle 116 such that the liquid contents of the bottle assembly 100 are contained when the nozzle 116 is closed and exits only through the nozzle opening 820 when the nozzle 116 is open. In the illustrated arrangement, the nozzle 116 includes an annular protrusion 832 extending in a circumferential direction around the outside surface of the nozzle portion 208. The annular protrusion 832 creates a seal with an interior surface of the tubular support 830. In the illustrated arrangement, a single annular protrusion 832 is provided, which reduces the resistance to movement of the nozzle 116 relative to a design that includes multiple protrusions 832. However, multiple protrusions 832 could be provided if sealing is of greater concern. Moreover, the arrangement could be reversed and the protrusion(s) 832 could be provided on the tubular support 830 instead of the nozzle 116.

The tubular support 830 defines one or more openings or windows 840 that are selectively opened or closed by the gate 828 of the nozzle portion 208. The window(s) 840 allow the liquid contents of the bottle assembly 100 to pass from the outside of the tubular support 830 to the interior space of the tubular support 830 when the gate 828 of the nozzle 116 is open. Access is then permitted to the nozzle opening 820 through the open bottom end of the nozzle portion 208. The annular protrusion 832 is always located above the window(s) 840 in the open or closed position of the nozzle 116 or at any position therebetween to maintain the seal. In the illustrated arrangement, the tubular support 830 includes multiple windows 840. In particular, the tubular support 830 includes three windows 840; however, other suitable numbers of windows 840 could be provided (e.g., 2, 4, 5, 6, 8, 9, 10 or more).

The illustrated nozzle portion 208 includes one or more ears 920. The ear(s) 920 extend in a radially outward direction from the outer surface of the nozzle portion 208 and project into or through corresponding ones of the windows 840. In the illustrated arrangement, the number of the ears 920 equals the number of windows 840 and, thus, each window 840 receives a corresponding ear 920. However, in other arrangements, the number of ears 920 could be less than the number of windows 840 such that one or more windows 840 do not have a corresponding ear 920 or the number of ears 920 could be greater than the number of windows 840 such that one or more windows 840 receive multiple ears 920. The ears 920 limit rotation of the nozzle 116 relative to the cap 102. Accordingly, this can maintain the vent plug portion 210 in proper alignment with the vent passage 944.

Figure 13:
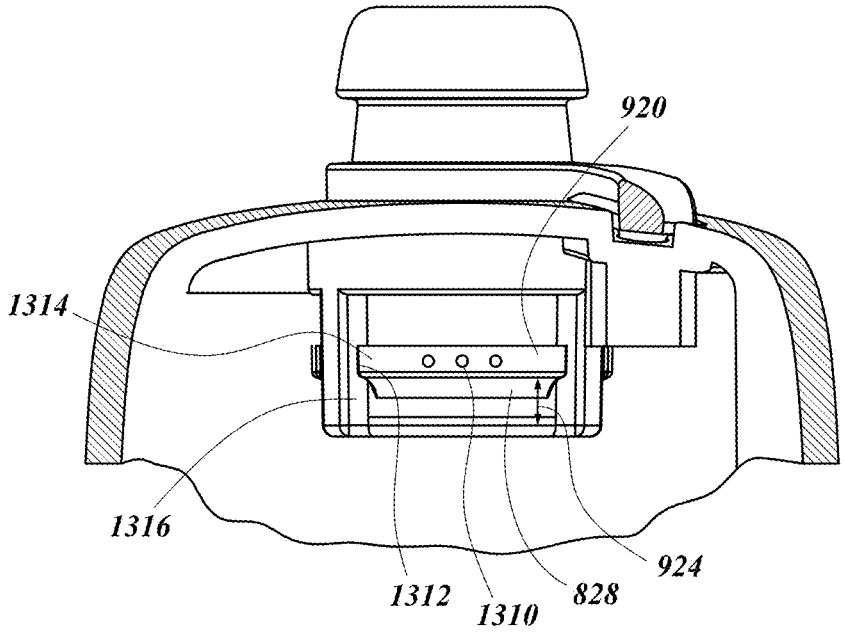
FIG. 13 is a profile view of a nozzle gate portion of the nozzle.

With reference to FIG. 13, an interface 1312 between each of the ears 920 and the windows 840 is configured to inhibit or prevent relative rotation between the nozzle 116 and the cap 102. In the illustrated arrangement, the interface 1312 can include a 90° angle on the edge 1314 of the ear 920 and a 90° angle on a pillar 1316 that is located beside and defines a side edge of the window 840. To ensure accurate seating of the vent plug portion 210 with the vent passage 944, each edge 1314 of the ears 920 may have a hard 90° angle that acts as a precise guide to ensure a proper rotational relationship between the nozzle 116 and the cap 102.

When nozzle 116 is in the down or closed position, the ear 920 and an upper surface of the corresponding window 840, which can be referred to herein as a stop surface 922, define a nozzle travel distance 924 between them. When the nozzle 116 is pulled upwards, the ear 920 abuts against the cap stop surface 922 to define the open position of the nozzle 116. The result is the opening of the gate 828, as illustrated in FIG. 8.

In some implementations, the tubular support 830 includes three pillars 1316. In other implementations, there may be more or less pillars 1316. In some implementations, there may be a one-to-one ratio between the number of ears 920 and the number of pillars 1316. An advantage of the three-pillar design may be that three pillars 1316 inhibit or substantially prevent rocking of the nozzle 116 when it is in either the open or closed position.

The tubular support 830 defines a valve seat that cooperates with the nozzle portion 208 to create a seal between the nozzle 116 and the cap 102 when the nozzle 116 is in the closed position. In the closed position, a round nozzle seal surface 926 defined by an end surface of the nozzle portion 208 abuts a bottom cap seal surface 928 defined by an end of the tubular support 830. Additionally, the bottom cap seal surface 928 may be of a more squared shape than the round nozzle seal surface 926 in cross-section, which results in contact between the two along a small area, which can be referred to as a contact line to distinguish seals created over a larger area of contact. The lower end of the tubular support 830 is closed to seal the end of the nozzle opening 820 when the nozzle 116 is closed. The closed end of the tubular support 830 can have an elevated inner platform 932. A transition between the bottom cap seal surface 928 and the elevated inner platform 932 can contact the inner surface of the nozzle portion 208 that defines the gate 828 to define an additional seal. The outside surface of the end portion of the nozzle portion 208 is tapered and, thus, spaced apart from the inside surface of the pillar 1316 forming a resultant void 938. The void 938 can provide clearance space to accommodate variations due to normal manufacturing tolerances.

In some embodiments, the nozzle 116 is constructed from a relatively hard durometer material to ensure durability of the nozzle surface and to maintain its form, reducing deformation. One advantage of reducing deformation is that the quality of the seals is more likely to remain suitable.

When the nozzle 116 is raised, the gates 828 open portions of the corresponding windows 840. In some implementations, in the fully open position of the nozzle 116, the open portion of the windows 840 defines a collective area of at least about 50 $mm^2$, at least about 65 $mm^2$, at least about 80 $mm^2$, at least about 90 $mm^2$, at least about 100 $mm^2$, at least about 125 $mm^2$, or at least about 130 $mm^2$. In some configurations, the collective open area of the windows 840 with the nozzle 116 in place is about 130 $mm^2$. This open area is sufficient, at least in combination with other features disclosed herein (e.g., the vent arrangement), to dispense about 21 oz. of liquid from the bottle assembly 100 in about 10 seconds or less using gravity force alone. Such dispensing performance is as good as or better than currently-marketed squeezable cycling water bottles.

In some implementations, the nozzle opening 820 has a minimum diameter 918 of at least about 9 mm, at least about 10 mm, at least about 12 mm, or at least about 13 mm (or an equivalent area for non-circular shapes) to achieve this flow rate. In other configurations, the minimum diameter 918 can be in the range of 5-20 mm, 8-18 mm, or 10-15 mm. Other dimensions of the relevant components can be selected to provide a desired flow rate of the dispensed liquid. For example, in some configurations, a high flow rate may not be necessary or desirable. In such configurations, a smaller minimum diameter 918 may be acceptable or desirable.

In some implementations, the windows 840 occupy a circumferential range of at least about 180°, 200°, 220°, 240° or 270° of the total possible 360° of the tubular support 830. In some configurations, the windows 840 occupy a circumferential range of about 270°. One advantage of this implementation is that it provides for advantageously high flow rates while keeping the nozzle travel distance 924 relatively small. In other embodiments, the circumferential range occupied by the windows 840 may be less than 270° or more than 270°.

Figure 14:
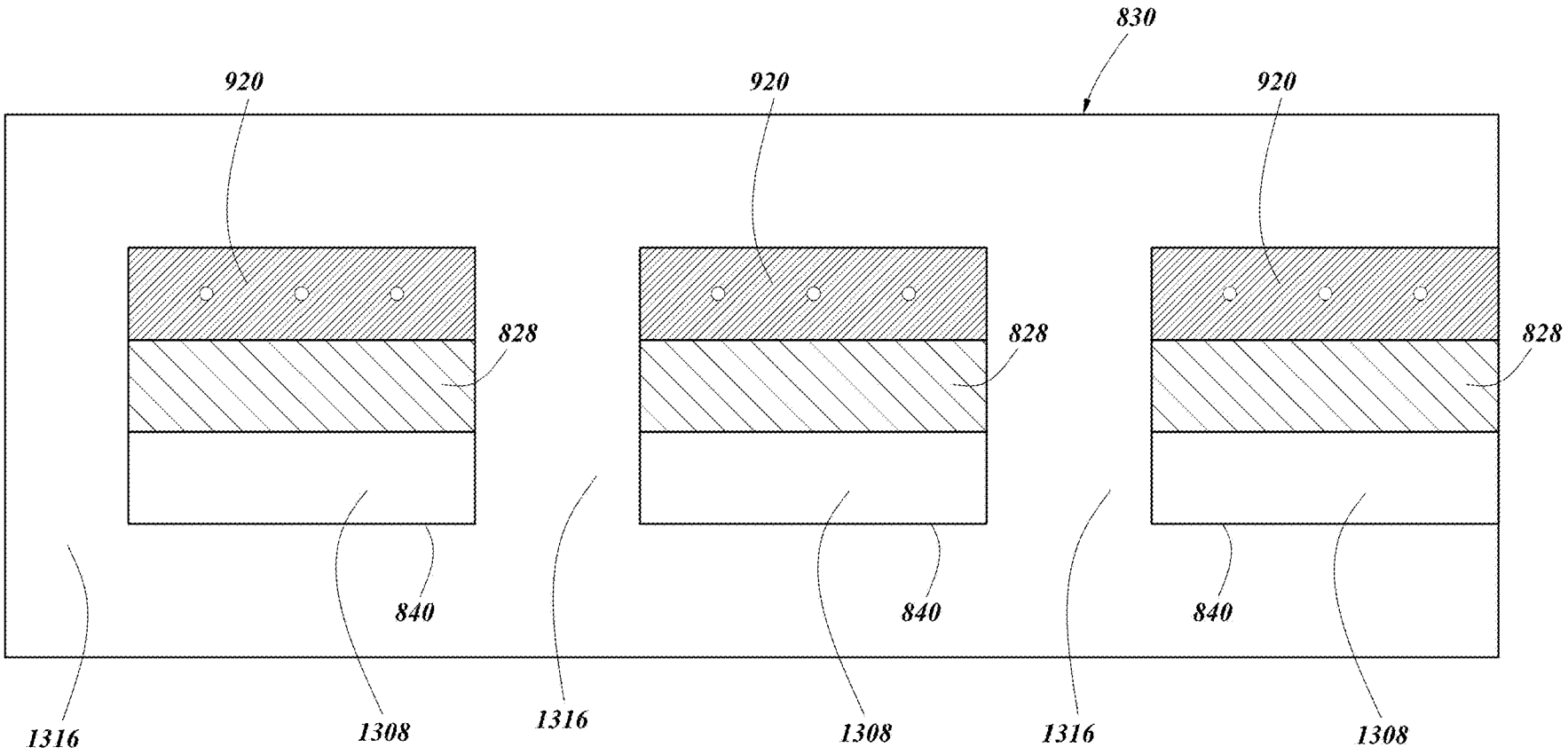
FIG. 14 is a two-dimensional map view of the nozzle gate.

FIG. 14 illustrates a visual representation or map of the tubular support 830 and the lower portion of the nozzle portion 208 that defines the gate 828 unrolled in flat form. As shown, the tubular support 830 includes three windows 840 defined between three pillars 1316. The gates 828 are shown in the open position of the nozzle portion 208 such that portions 1308 of the windows 840 are open. The total opening size of the collective open portions 1308 of the windows 840 can be within the ranges described above. In some embodiments, the total area of the open portions 1308 of the windows is sufficient to enable a target flow rate.

Figure 10:
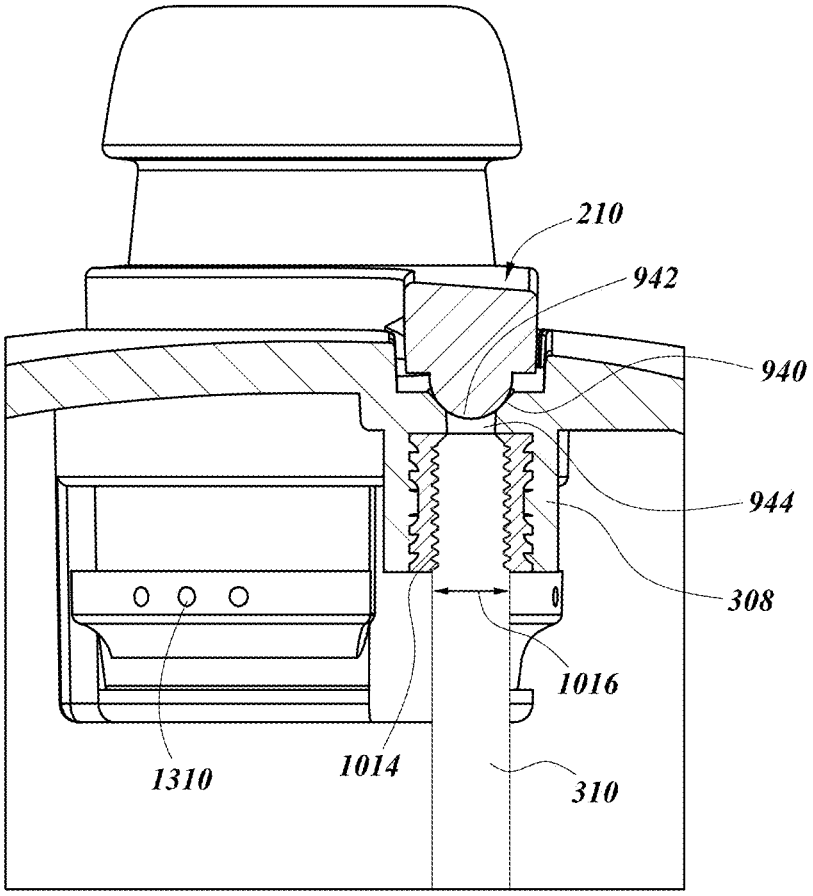
FIG. 10 is a sectional view of a portion of the cap showing the vent, including a vent plug and a vent straw.
Figure 11:
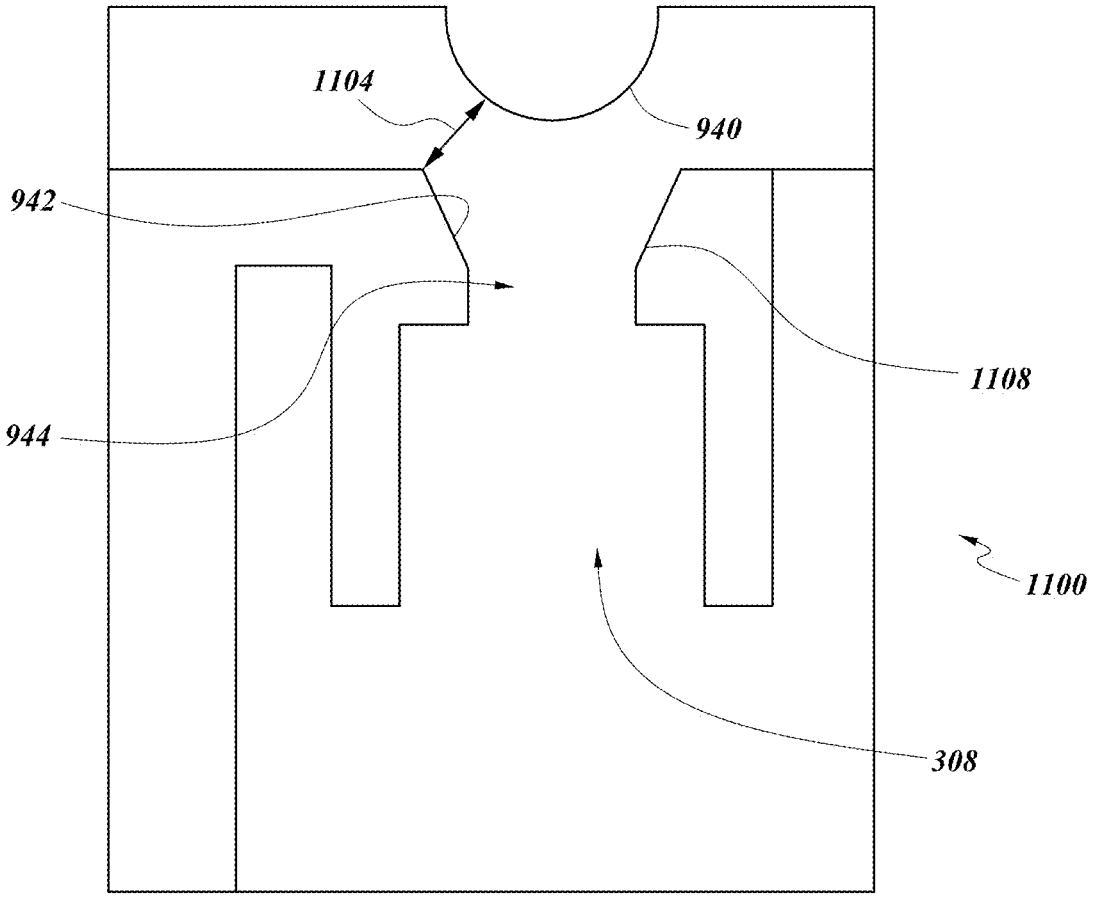
FIG. 11 is an enlarged sectional view of the vent and the vent plug in the open position.

As described above, the nozzle 116 includes a vent plug portion 210 configured to seal the vent passage 944 when the nozzle 116 is in the closed position. As illustrated in FIGS. 9-11, in some configurations, the vent plug portion 210 has a rounded seal portion or valve body, which can be in the form of a spherical or part spherical projection 940. The vent body 308 can define a recess 942 that surrounds the vent passage 944. The recess 942 can be defined by a square chamfer, which provides the recess 942 with an overall frustoconical shape. The projection 940 seals against the recess 942 when the vent plug portion 210 is in the closed position as shown in FIGS. 9 and 10. When the nozzle 116 is raised to the open position, the vent plug portion 210 is also raised and the projection 940 moves away from the recess 942. As a result, the vent passage 944 is opened to the ambient pressure. Opened to ambient pressure, the pressure within the bottle assembly 100 tends to equalize to the ambient pressure. In the closed position, the recess 942 is fully sealed by the projection 940 preferably along a circumferential contact line or small area.

With reference to FIG. 11, in some embodiments, the projection 940 and the recess 942 define a minimum clearance distance 1104 between them when the nozzle 116 is in the open position. The distance 1104 is selected such than a minimum flow area defined between the projection 940 and the recess 942 is equal to or larger than the minimum cross-sectional area of the vent passage 940 and/or the minimum cross-sectional area of the vent conduit 310. Such an arrangement ensures that the area defined between the projection 940 and the recess 942 is not a limiting factor for the flow of vent air 318. In some embodiments, the distance 1104 in the open position is at least about 2 mm, at least about 2.5 mm, at least about 3 mm, or at least about 3.5 mm (e.g., 3.6 mm). In some embodiments, the distance 1104 can be about 3.6 mm.

In some embodiments, the vent plug portion 210 has a thickness (in the vertical direction or in the direction of the longitudinal axis 120) in some areas of at least about 3 mm, or at least about 4 mm. This thickness may be enough to ensure sufficient force by the projection 940 on the recess 942 to create a reliable seal. The nozzle portion 208 and the tubular support 830 are configured to seal before the projection 940 seals with the recess 942. This is advantageous because it ensures that the water flow through the nozzle opening 820 is cut off before the vent plug portion 210 is fully engaged. In some embodiments, the vent plug 210 will deflect upwards somewhat when the nozzle portion 208 is fully seated in the valve seat of the tubular support 830. The ability for the vent plug portion 210 to deflect ensures that the nozzle portion 208 and the projection 940 can both seat with their respective structures of the cap 102 when the nozzle 116 is closed. This is advantageous in keeping manufacturing costs reasonable because the design is able to accommodate some dimensional variation while still providing desirable performance.

As illustrated in FIG. 10, the conduit 310 includes a threaded end 1014 configured to engage corresponding threads of vent body 308. An advantage of a threaded design is that the vent conduit 310 can be removed for easy cleaning of both the vent conduit 310 and the vent body 308 portion of the cap 102. As a further advantage, it allows for upgrades, such as replacing the vent conduit 310 with an upgraded version. For example, the bottle assembly 100 can be sold with a plastic vent conduit 310, which can be upgraded to a conduit 310 of a different material. In some implementations, the upgraded vent conduit 310 could be stainless steel, anodized aluminum, titanium, or other materials. Using a stainless steel vent conduit 310 or other rigid metal straw increases the durability of the vent assembly and of the overall bottle assembly 100. The rigid material also serves to prevent deformation. Additionally, the stainless steel, anodized aluminum, titanium, or other material may be resistant to corrosion. Stainless steel, titanium, anodized aluminum, or other materials are also useful because they will not contaminate the liquid contents of the bottle assembly 100 with chemicals or a chemical taste.

Figure 12:
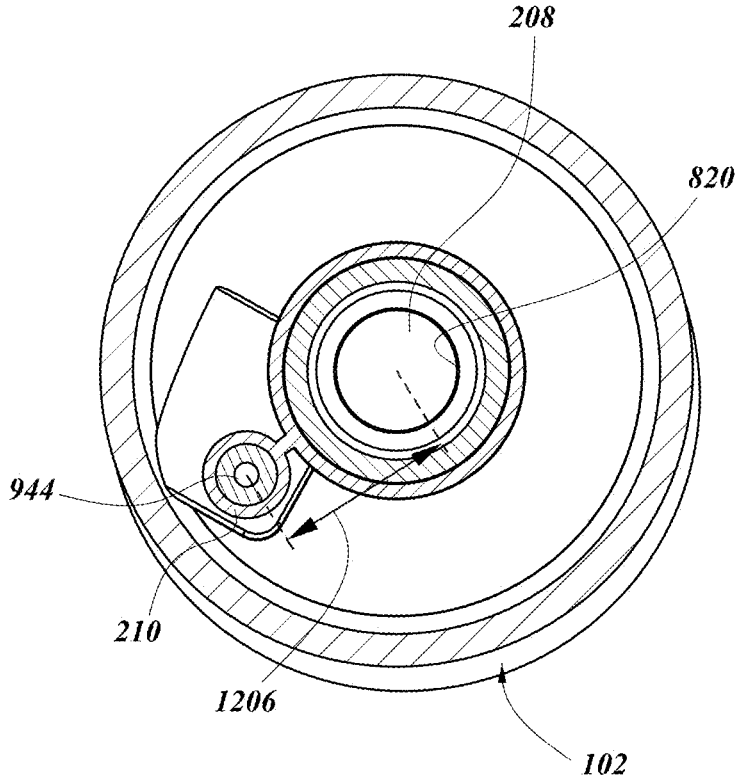
FIG. 12 is a sectional view showing the relative positions of the vent and the nozzle.

With reference to FIG. 12, as described above, the vent passage 944 can be offset from the nozzle opening 820 by a distance, such as an offset distance 1206. The offset distance 1206 can be defined as a distance between a center of the vent passage 944 and a center of the nozzle opening 820. In some configurations, the distance 1206 can be relatively small. For example, when a vent conduit 310 is used, the vent passage 944 can be located close to the nozzle opening 820 and/or the center of the bottle assembly 100 to increase the likelihood of the vent conduit 310 reaching the air cavity 312 regardless of the roll angle of the bottle assembly 100 to immediately start pressure equalization when the bottle assembly 100 is inverted. In some configurations, the offset distance 1206 is equal to or less than about 30 mm, 25 mm, 20 mm, or 15 mm. Because the vent plug portion 210 is located over top of the vent passage 944, pressure equalization between the air cavity 312 and ambient pressure can occur even when the nozzle 116 is fully covered or substantially fully covered by a user's mouth.

In other configurations, it may be desirable for the distance 1206 to be relatively large. For example, if no vent conduit 310 is used (e.g., the vent passage 944 vents directly into the interior of the bottle assembly 100), a larger distance 1206 can provide greater separation between the vent passage 944 and the nozzle passage 820. As a result, the incoming flow of vent air 318 is spaced further from the dispensing flow of water 316 to reduce or substantially eliminate entrainment of the vent air into the dispensing flow of water 316.

As described above, the nozzle 116 can be removable from the cap 102 for cleaning or replacement, for example. In the illustrated arrangement, each of the ears 920 includes one or more indents 1310. These indents 1310 may serve to identify to the user where the user should press to remove the nozzle 116 from the cap 102. In some embodiments, removal of the nozzle 116 is accomplished by pressing on the ears 920 of the nozzle 116 and simultaneously pushing the nozzle 116 upwards such that the ears 920 do not contact the cap stop surface 922 and instead proceeds upwards and out of the cap 102.

In some embodiments, a friction-enhancing material, such as a grip material 113, may be provided on a portion or an entirety of the bottle 104 to augment gripping of the surface 112, making it easier for a user to remove the cap 102. Similarly, if desired, a cap grip material 115 may be applied to the cap 102. This additional surface treatment may further enhance the ability of a user to remove the cap 102 from the bottle 104. In some embodiments, the bottle grip material 113 and the cap grip material 115 may be or comprise silicone. The silicone may be applied by spraying, dipping, or any other suitable process.

In some implementations, the bottle 104 may have a corner cushion 117 to protect the transition between the bottom and the sidewall 110 of the bottle 104 from denting. The corner cushion 117 could be a soft, resilient material. In some configurations, the corner cushion 117 could be a grip material, which can be the same as or different from the grip material 113 and/or 115. The corner cushion 117 may serve to absorb some of the impact energy when the bottle 104 is impacted—especially, for example, if the bottle 104 were dropped. The material of the corner cushion 117 may be selected to effectively reduce denting of the bottle 104. The cushion could be a silicone material. The corner cushion 117 and the grip material 113 of the bottle 104 may be formed as a single silicone sleeve. This silicone sleeve may have a built-up thickness around the bottom corners of the bottle 104. The silicone sleeve may be applied by spraying, dipping, or another application method. Alternatively, the cushion 117 could be made of one or more of a variety of suitable impact resistant materials.

Additionally, the bottle grip material 113, bottle grip material 115, and corner cushion 117 may individually, or in coordination with one another, serve to protect the bottle assembly 100, enhance the retention of the bottle assembly 100 and/or reduce noise when it is situated in a bottle cage on a bicycle. A typical metal bottle may rattle in the bottle cage, causing damage to the surface of a bottle, the bottle cage or at least creating an annoying level of noise. The bottle grip material 113, bottle grip material 115, and corner cushion 117 may individually, or in coordination inhibit or prevent the harmful or annoying rattle. Additionally, the bottle grip material 113 may have a built-up thickness as it approaches the shoulder section 108 of the bottle. A further advantage of the bottle grip material 113 and/or the cap grip material 115 is improved grip for the user, especially with a sweaty hand or glove. This may be particularly advantageous in a group event, in which a dropped water bottle can present a hazard to other cyclists. Increased grip on the bottle 104 may reduce the chance that the user drops the bottle 104 and thereby increase the safety to the user and those around them in comparison to conventional plastic or bare metal bottles.

The bottle 104 may be shaped and/or the grip material 113 may be selected to increase the ease of sliding the bottle assembly 100 into and out of the bottle cage attached to a bike. The cap 102 may, in some implementations, have a textured surface in addition to or in place of the cap grip material 115. This textured surface or cap grip design could make it easier for a user to remove the cap 102.

The entire cycling bottle assembly 100 may be coated in an insulated sleeve. The advantage of coating the cycling bottle assembly 100 in an insulated sleeve may be to keep contained fluids cold or hot. In another implementation the cycling bottle 104 may be a double walled vacuum insulated bottle. The cap 102 may in some implementations also be a double walled vacuum insulated cap.

Figure 16:
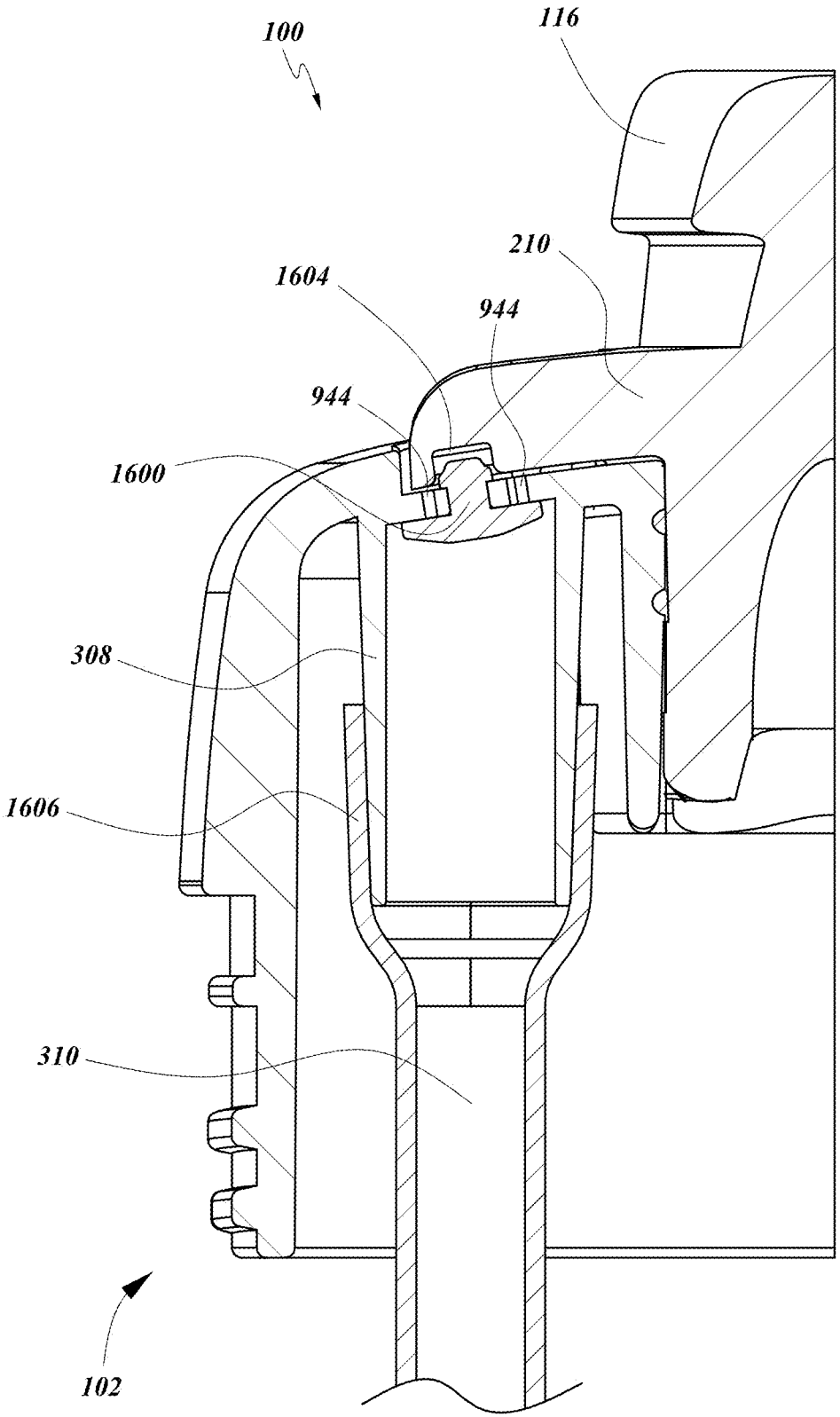
FIG. 16 is a sectional view of a portion of a modification of the bottle assembly of FIGS. 1-15 having a check valve associated with the vent.
Figure 17:
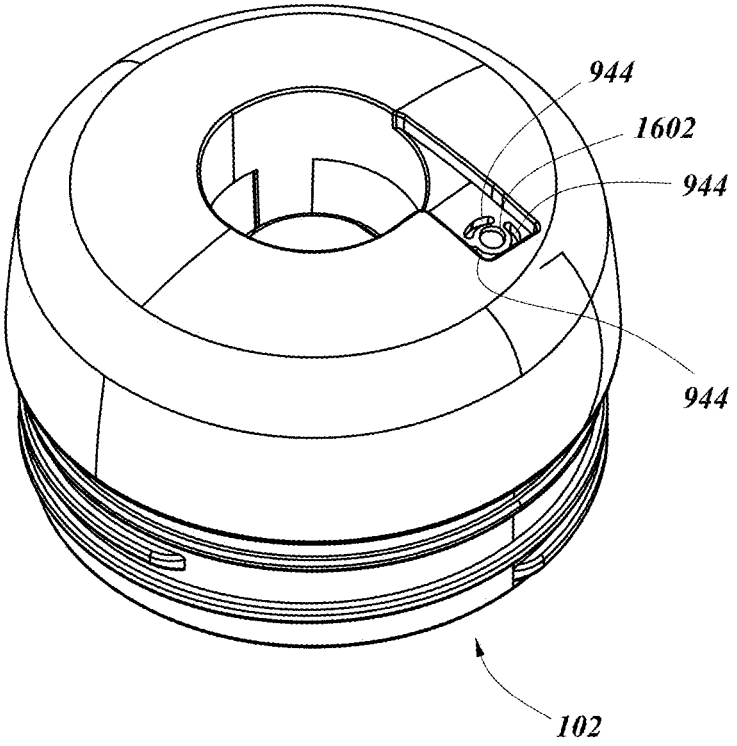
FIG. 17 is a perspective view of a lid of the bottle assembly of FIG. 16 with the nozzle removed to show underlying structure.

FIGS. 16 and 17 illustrate a modification of the bottle assembly 100 of FIGS. 1-15. In many respects, the bottle assembly 100 of FIGS. 16 and 17 can be the same as or similar to the bottle assembly 100 of FIGS. 1-15. Accordingly, the same reference numbers are used to refer to the same or corresponding features. The bottle assembly 100 of FIGS. 16 and 17 is described in the context of the differences from the bottle assembly of FIGS. 1-15. Features not described in detail can be the same as or similar to corresponding features of the bottle assembly 100 of FIGS. 1-15, or can be of another suitable arrangement. Moreover, the features of the bottle assembly of FIGS. 16 and 17 can be implemented on the bottle assembly 100 of FIGS. 1-15.

With reference to FIG. 16, the modified bottle assembly 100 can incorporate a check valve 1600 in the vent arrangement. In the illustrated arrangement, the check valve 1600 is configured to inhibit or prevent leakage of water or other liquid contents of the bottle assembly 100 through the vent passage(s) 944 in a direction from the interior to the exterior of the bottle assembly 100 and to permit the flow of vent air in a direction from the exterior to the interior of the bottle assembly 100. Accordingly, the check valve 1600 can inhibit or prevent the dribbling of water from the vent arrangement that could otherwise occur under certain circumstances. For example, if a user slowly tilts the bottle assembly 100 with the vent conduit 310 oriented toward the user such that it ends up at or near the bottom of the bottle assembly 100 when the bottle assembly 100 is moved toward or to a horizontal orientation, both the vent passage(s) 944 and a bottom of the vent conduit 310 could be exposed to the water or other liquid within the bottle assembly 100 at once, without a sufficient flow of vent air to prevent leakage through the vent arrangement. The provision of the check valve 1600 can inhibit or prevent leakage under such circumstances, while permitting the ingress of a flow of vent air for proper emptying of the liquid contents of the bottle assembly 100. Although it is presently preferred to include a vent conduit 310, the provision of a check valve 1600 can allow for the elimination of the vent conduit 310. However, as illustrated, the check valve 1600 can be used in combination with the vent conduit 310. Moreover, the check valve 1600 can be used in place of the vent plug portion 210 or the check valve 1600 can be used in combination with the vent plug portion 210 that is configured to seal the vent passage 944 when the nozzle 116 is in the closed position.

The check valve 1600 may be or comprise an umbrella valve or any other suitable type of valve arrangement. In the illustrated arrangement, the check valve 1600 comprises a valve body having a stem portion and a flattened head portion. The valve body can be constructed from any suitable material or combinations of material. For example, the valve body can be constructed from a resilient material, such as a silicone or another elastomeric material. As illustrated in FIG. 16, the stem portion of the check valve 1600 extends through an opening 1602 of the cap 102 of the bottle assembly 100. An end of the stem portion opposite the flattened head portion can be enlarged relative to a remainder of the stem portion to secure the check valve 1600 to the cap 102. The resiliency of the material of the valve body of the check valve 1600 can permit the enlarged end of the stem portion to be passed through the opening 1602 of the cap 102 for initial installation or to allow the valve body to be removed and replaced or cleaned.

The check valve 1600 may be assembled to the cap 102 such that the flattened head portion covers the vent passage (s) 944 on an interior surface of the cap 102 in a normal or relaxed position. Once assembled, the check valve 1600 regulates the vent flow of air through the vent passages 944. In particular, the vent flow of air flows through the vent passages 944 and opens the check valve 1600 when the liquid contents are dispensed from the bottle assembly 100. That is, as a result of the resiliency of the material of the valve body, the flattened head portion can be flexed open by the force of an incoming vent flow of air.

With reference to FIG. 17, the cap 102 may include multiple vent passages 944. In the illustrated arrangement, the cap 102 includes three vent passages 944. However, other numbers of vent passages 944 can be provided, such as 2, 4, 5, 6 or more vent passages 944. One or more, or each, of the vent passages 944 may have an arcuate shape or may be bean-shaped. The vent passages 944 may also have other appropriate shapes. The vent passages 944 may be generally arranged in a circle around the opening 1602 of the cap 102 that receives the valve body of the check valve 1600. The vent passages 944 may be sized such that the total cross-sectional area of all the vent passages 944 is equal to or greater than the cross-sectional area of the vent conduit 310. This is advantageous to ensure that the vent passages 944 are not a limiting factor in the air flow rate through the vent conduit 310.

In some embodiments, the vent plug portion 210 of the nozzle 116 is configured to accommodate a portion of the check valve 1600. In the illustrated arrangement, the vent plug portion 210 has a recess 1604 disposed near the distal end. The recess 1604 is configured to receive a portion of the check valve 1600 that protrudes above the exterior surface of the cap 1602 (e.g., the enlarged end of the stem portion). The vent plug portion 210 covering the check valve 1600 is advantageous to reduce exposure of the check valve 1600 to dirt, debris or other foreign materials. This is an important feature because it can increase the reliable operation of the check valve 1600 and/or may increase the useful life of the check valve 1600 or increase the interval between cleaning of the check valve 1600. Additionally, physical damage by a foreign object can be inhibited or prevented by covering the check valve 1600 with the vent plug portion 210. This may be particularly important when the bottle assembly 100 is used as a sports bottle, such as a cycling bottle carried within a bottle cage of a bicycle. In such case, the bottle assembly 100 may exposed to substantial amounts of mud, dirt and other materials.

In the illustrated configuration, the vent plug portion 210 simply covers the check valve 1600 and vent passages 944 of the vent arrangement, but does not seal against the cap 102. Such an arrangement reduces the complexity of manufacturing by eliminating the precision necessary of sealing surfaces. However, in some configurations, the vent plug portion 210 could be configured to seal the vent passages 944. Such an arrangement provides the advantage of a seal that is redundant to the check valve 1600, which can inhibit or prevent leakage under certain circumstances in the event of failure of the check valve 1600.

In some embodiments, the vent conduit 310 and the vent body 308 can be connected by a press-fit or friction-fit coupling arrangement, rather than a threaded coupling. Such an arrangement can ease assembly or disassembly by the user, which can ease replacement or cleaning of the vent conduit 310. In some configurations, the vent body 308 may define a tapered surface that may fit snugly into a receiving portion 1606 of the vent conduit 310. In some embodiments, the vent conduit 310 may be made of silicone or another elastomeric material(s), or another suitable material or combination of materials.

Figure 18:
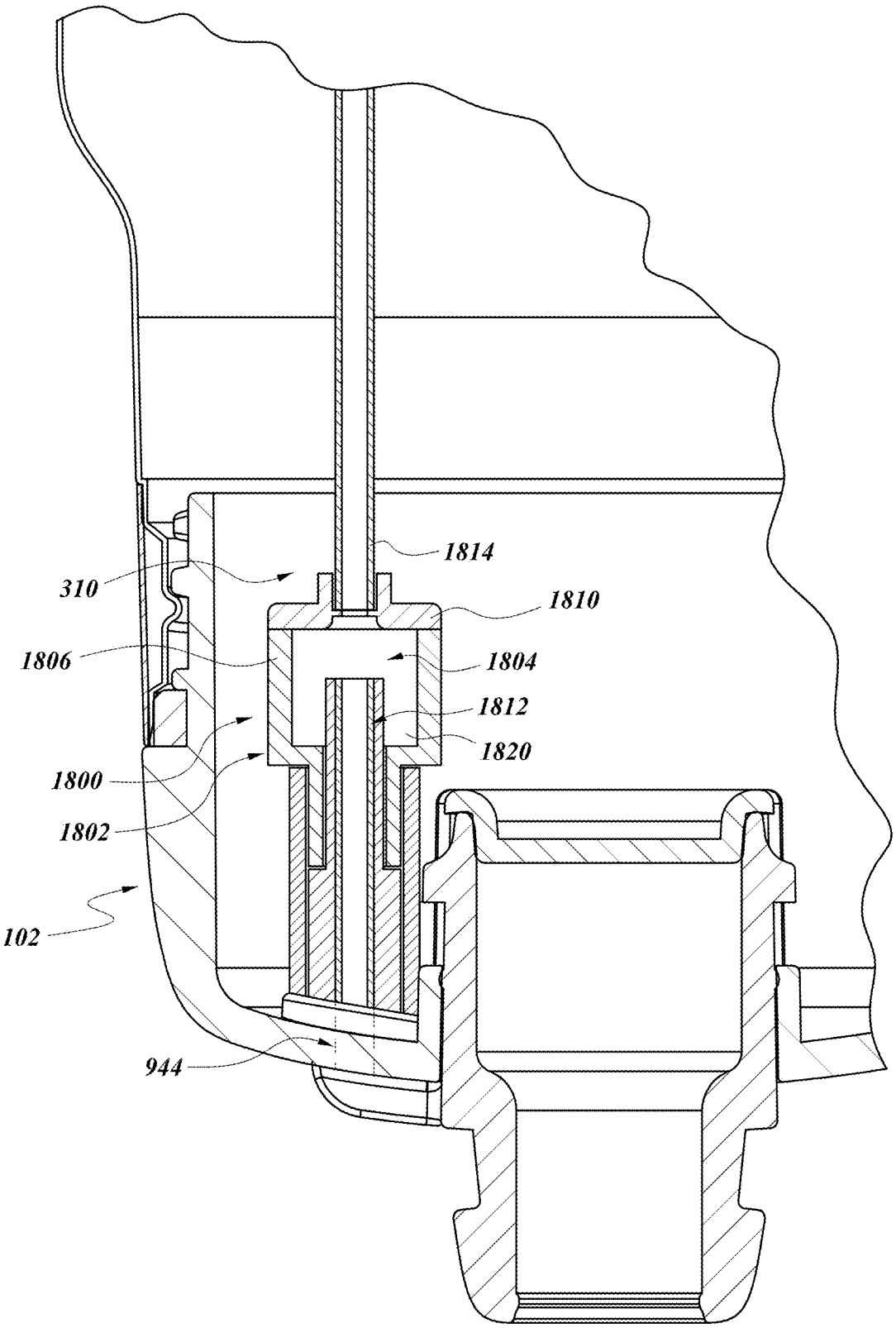
FIG. 18 is a sectional view of a portion of an alternative bottle assembly showing a water trap arrangement of the vent conduit. The lid is oriented upside down in FIG. 18 with the nozzle toward the bottom of the figure.

Another embodiment of the bottle assembly 100 is described with reference to FIG. 18, which illustrates a cap 102 and vent conduit 310. In many respects, the bottle assembly 100 of FIG. 18 can be the same as or similar to the bottle assemblies 100 of FIGS. 1-17. Accordingly, the same reference numbers are used to refer to the same or corresponding features. The bottle assembly 100 of FIG. 18 is described in the context of the differences from the bottle assemblies of FIGS. 1-17. Features not described in detail can be the same as or similar to corresponding features of the bottle assemblies 100 of FIGS. 1-17, or can be of another suitable arrangement.

In the bottle assembly 100 of FIG. 18, the vent conduit 310 incorporates a water trap arrangement 1800, which can be in place of, or in addition to, the check valve 1600. The water trap arrangement 1800 is configured to accumulate or trap water or other liquid contained within the bottle assembly 100 that enters the vent conduit 310 and inhibit or prevent that water from exiting the bottle assembly 100 through the vent passage(s) 944. The water trap arrangement 1800 is located within the vent conduit 310 between the terminal end 332 of the vent conduit 310 and the vent passage(s) 944. In the illustrated arrangement, the water trap arrangement 1800 is located closer to the cap 102 than the terminal end 332 of the vent conduit 310 and can be located substantially adjacent the cap 102.

The water trap arrangement 1800 includes a body 1802 that defines an interior chamber 1804. The illustrated body 1802 includes a hollow base portion 1806 and a cap 1810 that closes an open end of the hollow base portion 1806. In the illustrated arrangement, the base portion 1806 is located closer to the top end of the bottle cap 102 and the cap 1810 is located further from the top end of the bottle cap 102. However, this arrangement could also be reversed.

The vent conduit 310 is divided into a portion 1812 between the vent passage(s) 944 and the chamber 1804, which can be referred to as a down straw 1812, and a portion 1814 opposite the chamber 1804 from the down straw 1812, which can be referred to as a main straw 1814. The main straw 1814 can extend from the chamber 1804 towards the bottom end of the bottle 104 as described herein with reference to FIGS. 3 and 15, for example. In some configurations, the down straw 1812 is a separate component from the bottle cap 102 and is secured to the cap 102. Preferably, the down straw 1812 is removable from the cap 102 to allow for cleaning and/or replacement. For example, the down straw 1812 can be secured to the cap 102 by a mechanical connection, such as a threaded connection or press-fit (interference) connection. However, in other configurations, the down straw 1812 is integral with or is unitarily formed with the cap 102.

The base portion 1806 can be secured to the down straw 1812 or directly to the bottle cap 102. In some configurations, the base portion 1806 is directly connected to the cap 102 and secures the down straw 1812 relative to the bottle cap 102. The cap 1810 can be secured to the base portion 1806 by any suitable connection, such as a press-fit or threaded connection, for example. In some configurations, the cap 1810 is removable from the base portion 1806 to allow for replacement of the cap 1810 or cleaning of the water trap arrangement 1800. Similarly, the main straw 1814 can be secured to the cap 1810 by any suitable arrangement, such as a press-fit or threaded connection, for example. In some configurations, the main straw 1814 is removable from the cap 1810 to allow for replacement or cleaning of the main straw 1814.

The down straw 1812 protrudes into the chamber 1804 such that a space 1820 is defined between an end of the down straw 1812 and the interior surface of the closed end of the base portion 1806. The space 1820 can be an annular or generally annular shape in configurations in which the side wall of the base portion 1806 surrounds and is spaced from the down straw 1812. The space 1820 can function as an accumulation space or trap space that accommodates water or other liquid from the main straw 1814 when the bottle assembly 100 is tilted. In some configurations, a volume of the space 1820 can be equal to or greater than an interior volume of the main straw 1814. With the volume of the space 1820 greater than the interior volume of the main straw 1814, it is possible for the space to accommodate a volume of water equal to the entirety of the interior volume of the main straw 1814. With the volume of the space 1820 greater than the interior volume of the main straw 1814, it is possible for the space 1820 to accommodate a volume of water equal to the entirety of the interior volume of the main straw 1814 with the bottle assembly 100 tilted to some degree. Such an arrangement can reduce or eliminate water located within the main straw 1814 from exiting the vent passages 944.

In some configurations, the interior diameter of the main straw 1814 is at least about 7 mm or is of an equivalent interior cross-sectional area for non-circular shapes. Such an arrangement can allow the water or other liquid within the main straw 1814 to readily empty into the accumulation space 1820 so that the flow of vent air can pass without restriction, or without substantial restriction, from the vent passage(s) 944 to the interior of the bottle assembly 100.

Figure 19:
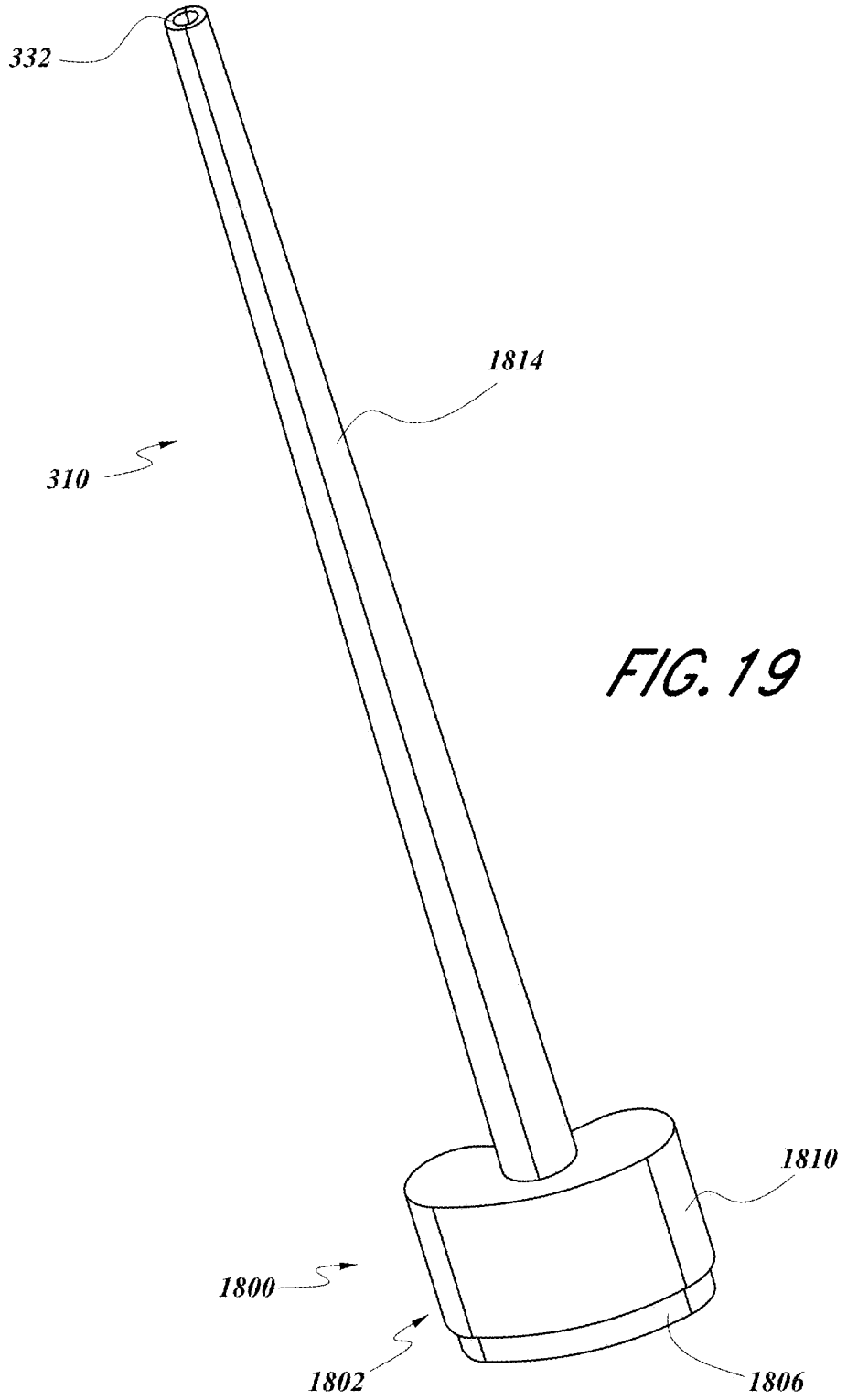
FIG. 19 is a perspective view of an alternative vent conduit with water trap arrangement, in which the water trap arrangement has a non-circular shape and a tapered main vent conduit.
Figure 20:
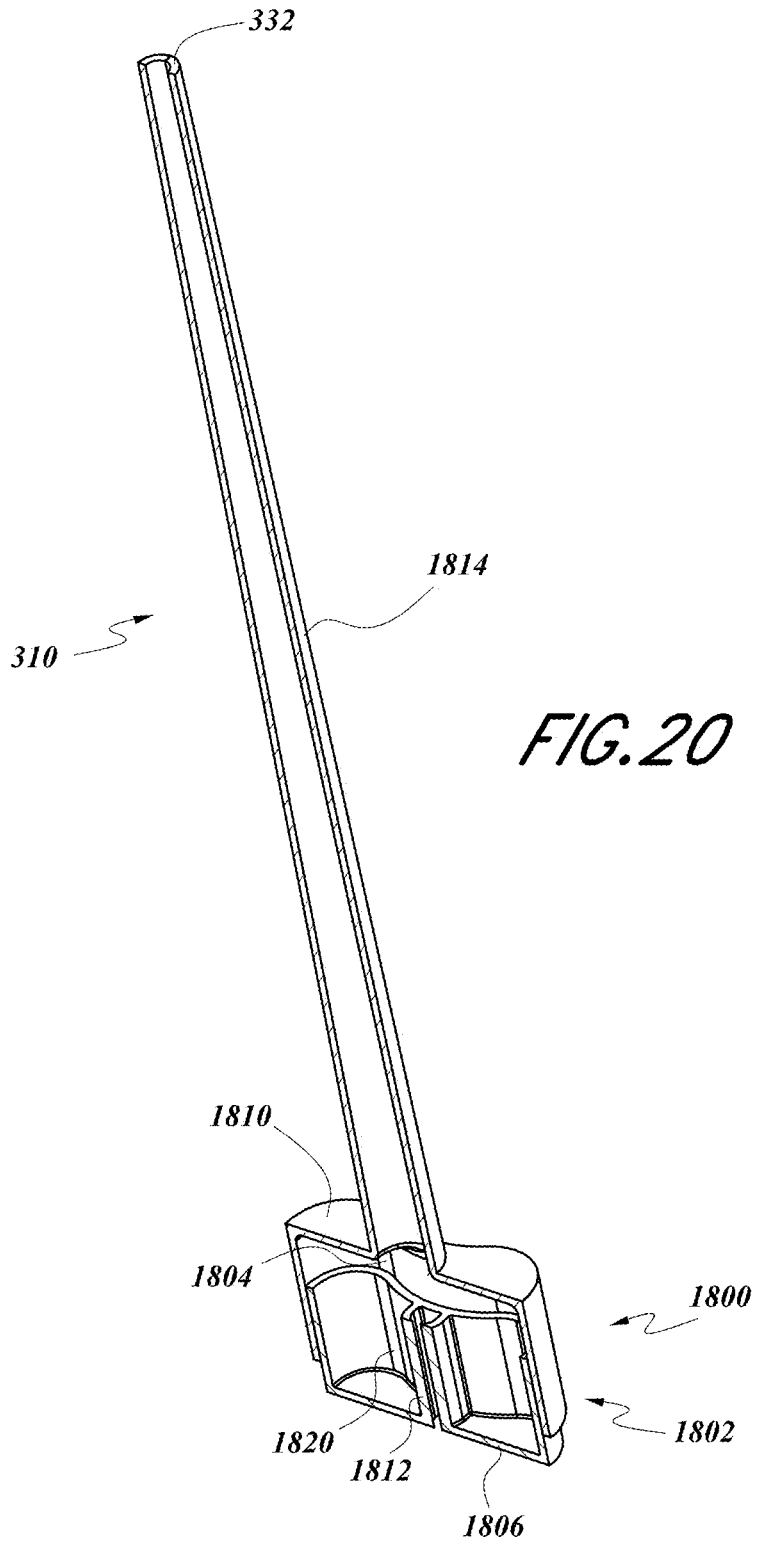
FIG. 20 is a sectional view of the vent conduit with water trap arrangement of FIG. 19.

FIGS. 19 and 20 illustrate a modification of the vent conduit 310 with water trap arrangement 1800. In many respects, the vent conduit 310 with water trap arrangement 1800 of FIGS. 19 and 20 can be the same as or similar to the vent conduit 310 with water trap arrangement 1800 of FIG. 18. Accordingly, the same reference numbers are used to refer to the same or corresponding features. The vent conduit 310 with water trap arrangement 1800 of FIGS. 19 and 20 is described in the context of the differences from the vent conduit 310 with water trap arrangement 1800 of FIG. 18. Features not described in detail can be the same as or similar to corresponding features of the vent conduit 310 with water trap arrangement 1800 of FIG. 18, or can be of another suitable arrangement.

The vent conduit 310 with water trap arrangement 1800 of FIGS. 19 and 20 includes a tapered main straw 1814. The diameter or cross-sectional area of the main straw 1814 can increase from a terminal end 332 towards or to the water trap arrangement 1800. Such an arrangement can inhibit entry of water or other liquid into the terminal end of the main straw 1814 and can permit water or other liquid that does get into the main straw 1814 to readily exit into the accumulation space 1820 of the water trap arrangement 1800. In addition, such an arrangement reduces the interior volume of the main straw 1814 relative to a main straw 1814 having the maximum diameter along its entire length. In some configurations, the tapered main straw 1814 can have a minimum diameter of about 3 mm or an equivalent cross-sectional area for non-circular shapes and a maximum diameter of at least about 7 mm or an equivalent cross-sectional area for non-circular shapes.

The water trap arrangement 1800 of FIGS. 19 and 20 has a non-circular shape when viewed along a longitudinal axis of the bottle assembly 100 or from above or below the bottle cap 102. In some configurations, the water trap arrangement 1800 can have a part annular shape or can be generally bean-shaped. Such an arrangement can take advantage of the annular space surrounding the nozzle 116 so that the volume of the interior chamber 1804, and thus the accumulation space 1820, can be greater than a circular water trap arrangement 1800 of a similar radial dimension. Such an arrangement can better accommodate water from the main straw 1814 even when the bottle assembly 100 is tilted.

In the arrangement of FIGS. 19 and 20, the down straw 1812 is integral with or unitarily formed with a first portion 1806 of the body 1802 of the water trap arrangement 1800 and the main straw 1814 is integral with or unitarily formed with a second portion 1810 of the body 1802 of the water trap arrangement 1800. The portions of the body 1802 can be coupled (e.g., removably coupled) by any suitable arrangement, such as a press-fit, for example. The water trap arrangement 1800 and conduit 310 can be coupled (e.g., removably coupled) to the bottle cap 102 by any suitable arrangement, such as a press-fit, for example.

Figure 21:
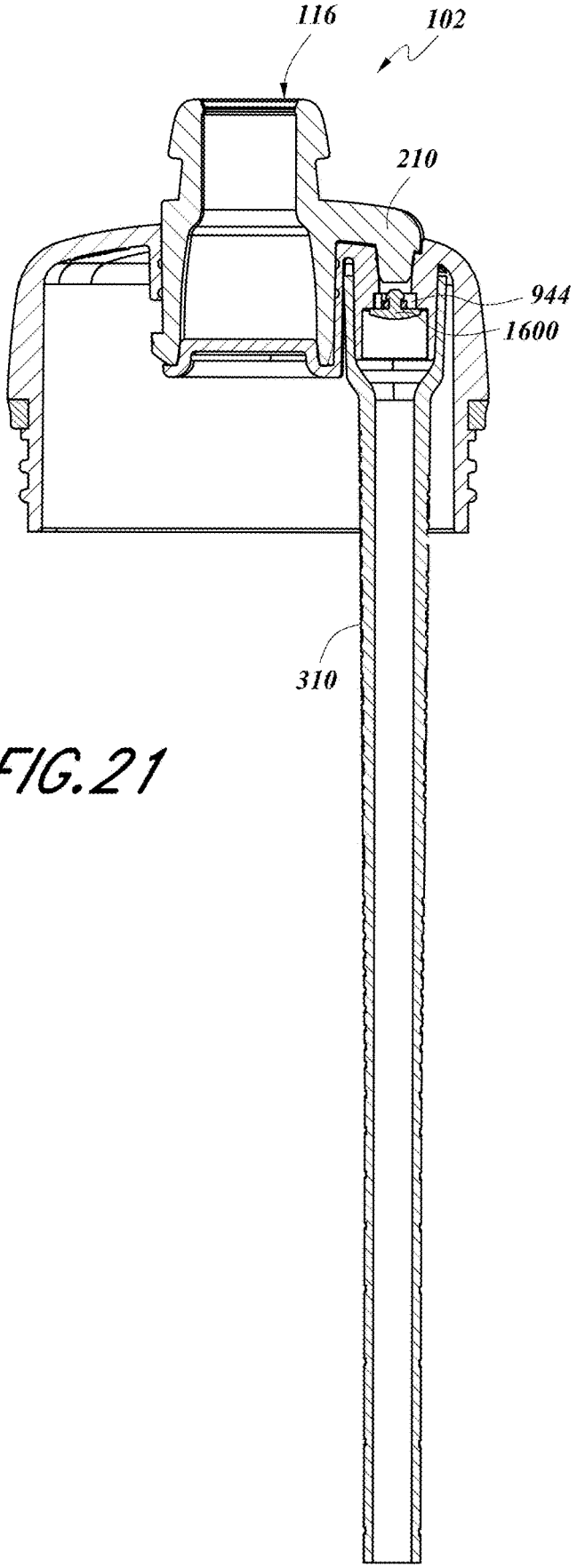
FIG. 21 is a sectional view of an alternative cap having a check valve in combination with an alternative vent plug.
Figure 22:
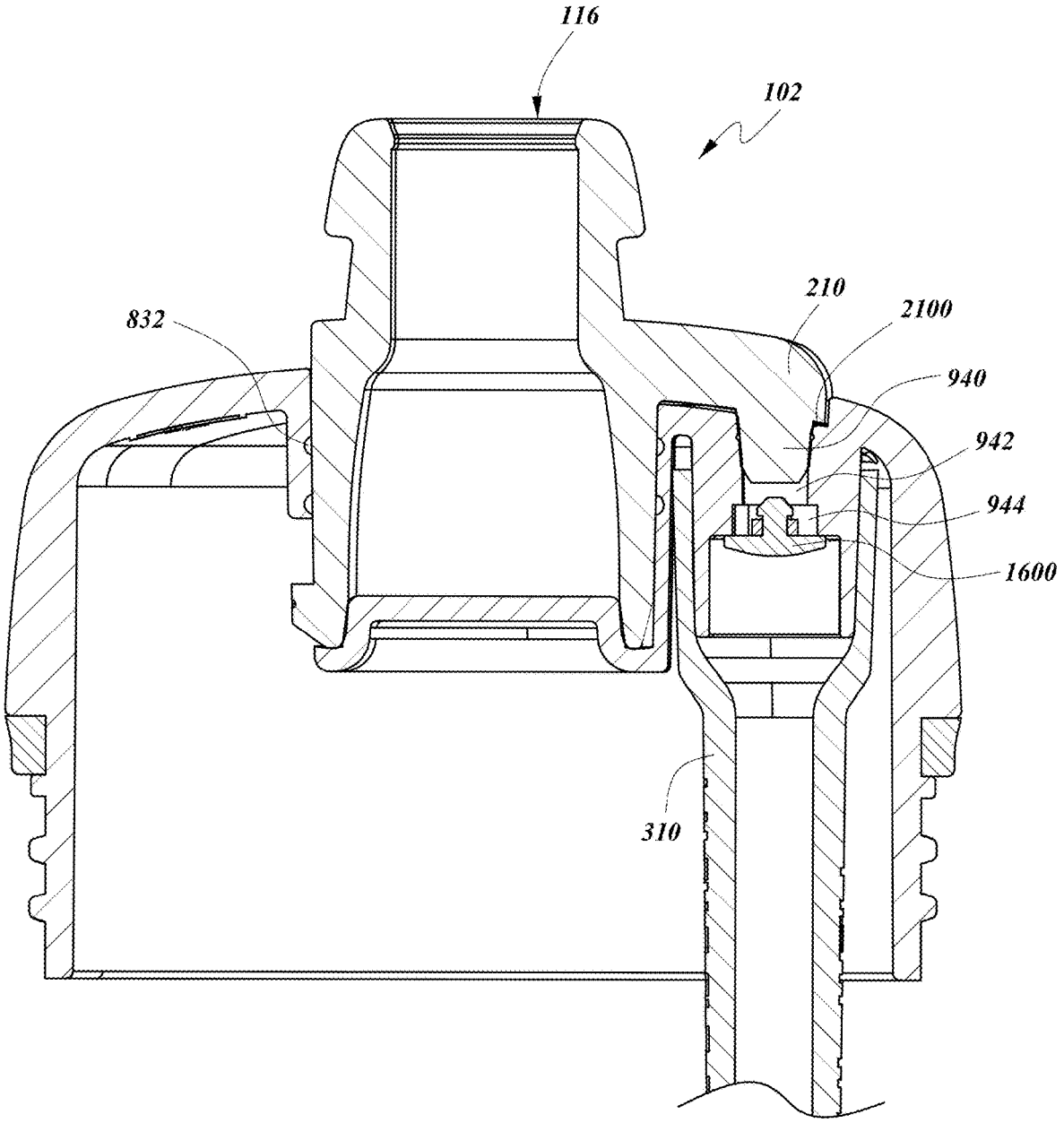
FIG. 22 is an enlarged sectional view of the cap of FIG. 21 and showing only a portion of the vent conduit.

FIGS. 21 and 22 illustrate a modification of a cap 102 of the bottle assemblies 100 of FIGS. 1-20. In many respects, cap 102 of FIGS. 21 and 22 can be the same as or similar to the caps 102 of the bottle assemblies 100 of FIGS. 1-20. Accordingly, the same reference numbers are used to refer to the same or corresponding features. The cap 102 of FIGS. 21 and 22 is described in the context of the differences from caps 102 of the bottle assemblies 100 of FIGS. 1-20. Features not described in detail can be the same as or similar to corresponding features of the caps 102 of the bottle assemblies 100 of FIGS. 1-20, or can be of another suitable arrangement. Moreover, the features of the cap 102 of FIGS. 21 and 22 can be implemented on any of the bottle assemblies 100 of FIGS. 1-20.

The cap 102 of FIGS. 21 and 22 incorporates a check valve 1600 in the vent arrangement. As described previously, the check valve 1600 is configured to inhibit or prevent leakage of water or other liquid contents of the bottle assembly 100 through the vent passage(s) 944 in a direction from the interior to the exterior of the bottle assembly 100 and to permit the flow of vent air in a direction from the exterior to the interior of the bottle assembly 100. Accordingly, the check valve 1600 can inhibit or prevent leakage of liquid from the bottle assembly 100 through the vent passage 944, while permitting the ingress of a flow of vent air for proper emptying of the liquid contents of the bottle assembly 100.

In the illustrated arrangement, the check valve 1600 is used in combination with the vent conduit 310. However, unlike the arrangement of FIGS. 16 and 17, in the arrangement of FIGS. 21 and 22 the check valve 1600 is used in combination with the vent plug portion 210 that is configured to seal the vent passage 944 when the nozzle 116 is in the closed position. The illustrated vent plug portion 210 varies from the previously described vent plug portion 210 of FIGS. 1-15. In particular, in arrangement of FIGS. 21 and 22 the vent plug portion 210 enters into the vent passage 944 and seals along the side wall of the vent passage 944 instead of abutting against a chamfered surface in a line contact as in the vent plug portion 210 of FIGS. 1-15. The vent passage 944 of FIGS. 21 and 22 includes an elongate cylindrical recess 942 that receives the elongate generally cylindrical projection 940 of the vent plug portion 210. The projection 940 of the vent plug portion 210 can be slightly tapered in a direction towards the free end (nearest the check valve 1600). The projection 940 of the vent plug portion 210 can include one or more (e.g., two) annular protrusions 2100 that are similar in structure and function to the annular protrusions 832 of the nozzle 116. The annular protrusions 2100 can assist in creating a seal between the projection 940 of the vent plug portion 210 and the recess 942 of the vent passage 944 without creating excessive resistance to movement of the vent plug portion 210 within the vent passage 944. The combination of the tapered projection 940 of the vent plug portion 210 and the annular protrusions 832 provides advantageous closing and sealing performance of the nozzle 116.

As described previously, the check valve 1600 may be or comprise an umbrella valve or any other suitable type of valve arrangement. The valve body can be constructed from any suitable material or combinations of material. For example, the valve body can be constructed from a resilient material, such as a silicone or another elastomeric material. The check valve 1600 is assembled to the cap 102 such that the flattened head portion covers the vent passage(s) 944 on an interior surface of the cap 102 in a normal or relaxed position. Once assembled, the check valve 1600 regulates the vent flow of air through the vent passages 944. In particular, the vent flow of air flows through the vent passages 944 and opens the check valve 1600 when the liquid contents are dispensed from the bottle assembly 100. The vent plug portion 210 provides an additional liquid seal when the nozzle 116 is closed and inhibits or prevents dirt, debris or similar foreign material from entering the vent passage 944 and interfering with the operation of the check valve 1600.

As described previously, the cap 102 may include multiple vent passages 944. In the illustrated arrangement, the cap 102 includes three vent passages 944. One or more, or each, of the vent passages 944 may have an arcuate shape or may be bean-shaped. The vent passages 944 may also have other appropriate shapes. The vent passages 944 may be generally arranged in a circle around the opening 1602 (FIG. 17) of the cap 102 that receives the valve body of the check valve 1600. The vent passages 944 may be sized such that the total cross-sectional area of all the vent passages 944 is equal to or greater than the cross-sectional area of the vent conduit 310, such as the minimum cross-sectional area of the vent conduit 310. This is advantageous to ensure that the vent passages 944 are not a limiting factor in the air flow rate through the vent conduit 310.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A sports beverage bottle assembly, comprising:

a bottle defining a closed bottom end and an open top end;

a cap selectively connectable to the bottle and configured to close the open top end of the bottle, wherein the bottle and the cap cooperate to define an interior, the cap comprising:

a tubular support that extends from an interior surface of the cap; and a tubular vent body that extends from the interior surface of the cap;

a nozzle carried by the tubular support of the cap, the nozzle movable between an open position and a closed position, the nozzle comprising an outlet passage;

a vent configured to permit a vent flow of vent air from an atmosphere outside of the bottle assembly to an interior space of the bottle assembly through a vent passage;

a vent conduit that extends from the vent passage to a terminal end located within the bottle, wherein the vent conduit is attached to the tubular vent body;

a check valve configured to permit the vent flow of air and inhibit or prevent a flow of air or the liquid contents through the vent passage in a direction from the interior space of the bottle assembly to the atmosphere, wherein the check valve comprises:

an umbrella valve having a stem portion and a flattened head portion, wherein the stem portion extends through an opening in the cap and the flattened head portion is positioned against an interior surface of the cap; and multiple vent passages arranged around the opening, wherein the flattened head portion covers the multiple vent passages in a normal position and flexes to open the multiple vent passages in response to the vent flow of air;

wherein the bottle assembly is configured to dispense the liquid contents through the outlet passage of the nozzle in response to the bottle assembly being tilted toward an inverted position such that the liquid contents enters the outlet passage of the nozzle.

2. The sports beverage bottle assembly of claim 1, wherein the movement of the nozzle between the open position and the closed position is twisting or linear movement.

3. The sports beverage bottle assembly of claim 1, wherein the vent passage extends through the cap at a location spaced from a nozzle receiver opening through an exterior surface of the cap that opens into an interior space of the tubular support.

4. The sports beverage bottle assembly of claim 1, wherein the bottle is constructed of a rigid material.

5. The sports beverage bottle assembly of claim 1, wherein the nozzle comprises a nozzle portion and an arm that extends tangentially outward from the nozzle portion.

6. The sports beverage bottle assembly of claim 1, wherein the vent conduit comprises an enlarged upper end that is configured to engage the tubular vent body.

7. The sports beverage bottle assembly of claim 6, wherein the vent conduit tapers in a direction from the enlarged upper end to the terminal end.

8. The sports beverage bottle assembly of claim 1, wherein an outlet opening of the outlet passage of the nozzle is located on an upper end of the nozzle.

9. The sports beverage bottle of claim 1, wherein a total area of the multiple vent passages is equal to or greater than a minimum cross-sectional area of the vent conduit.

10. The sports beverage bottle of claim 1, wherein each of the multiple vent passages has an arcuate shape.

11. A sports beverage bottle assembly, comprising:

a bottle defining a closed bottom end and an open top end;

a cap selectively connectable to the bottle and configured to close the open top end of the bottle, wherein the bottle and the cap cooperate to define an interior, the cap comprising:

a tubular support that extends from an interior surface of the cap; and a tubular vent body that extends from the interior surface of the cap;

a nozzle carried by the tubular support of the cap, the nozzle movable between an open position and a closed position, the nozzle comprising an outlet passage, wherein the tubular support and the nozzle cooperate to define one or more windows that permit entry of the liquid contents into the outlet passage of the nozzle through a circumferential surface of the tubular support, wherein the nozzle comprises a plurality of radially-outward-projecting ears that engage the tubular support to define the open position of the nozzle;

a vent configured to permit a vent flow of vent air from an atmosphere outside of the bottle assembly to an interior space of the bottle assembly through a vent passage;

a vent conduit that extends from the vent passage to a terminal end located within the bottle, wherein the vent conduit is attached to the tubular vent body;

wherein the bottle assembly is configured to dispense the liquid contents through the outlet passage of the nozzle in response to the bottle assembly being tilted toward an inverted position such that the liquid contents enters the outlet passage of the nozzle;

wherein the nozzle is configured to be removable from the cap by pressing on a side of the nozzle and collapsing the nozzle such that the ears do not engage the tubular support and the nozzle can move upwards and out of the cap.

12. The sports beverage bottle of claim 11, wherein the nozzle comprises an indicator to indicate to the user the location on the nozzle to press for removal of the nozzle.

13. A sports beverage bottle assembly, comprising:

a bottle defining a closed bottom end and an open top end;

a cap selectively connectable to the bottle and configured to close the open top end of the bottle, wherein the bottle and the cap cooperate to define an interior, the cap comprising:

a tubular support that extends from an interior surface of the cap; and a tubular vent body that extends from the interior surface of the cap, wherein the tubular vent body comprises a cylindrical outer surface;

wherein the tubular support and the cylindrical outer surface of the tubular vent body define a space therebetween;

a nozzle carried by the tubular support of the cap, the nozzle movable between an open position and a closed position, the nozzle comprising an outlet passage having no interior obstructions and having a minimum diameter of at least 9 millimeters;

a vent configured to permit a vent flow of vent air from an atmosphere outside of the bottle assembly to an interior space of the bottle assembly through a vent passage;

a vent conduit that extends from the vent passage to a terminal end located within the bottle, wherein the vent conduit is friction fit onto the cylindrical outer surface of the tubular vent body with a portion of the vent conduit received in the space between the tubular support and the cylindrical outer surface of the tubular vent body, wherein the vent conduit has a minimum internal diameter of at least 3 mm;

wherein the bottle assembly is configured to dispense the liquid contents through the outlet passage of the nozzle in response to the bottle assembly being tilted toward an inverted position such that the liquid contents enters the outlet passage of the nozzle.

14. The sports beverage bottle of claim 13, wherein the tubular support and the nozzle cooperate to define one or more windows that permit entry of the liquid contents into the outlet passage of the nozzle, wherein the one or more windows define a total area of at least 65 square millimeters.

15. The sports beverage bottle of claim 14, wherein the one or more windows occupy a circumference of at least 270 degrees of the tubular support.

16. The sports beverage bottle of claim 13, wherein the bottle is configured to dispense about 21 oz. of liquid from the bottle in about 10 seconds or less using gravity force alone.

* * * * *